US007510055B2

(12) United States Patent
Morotome et al.

(10) Patent No.: US 7,510,055 B2
(45) Date of Patent: Mar. 31, 2009

(54) DOOR DEVICE OF ELEVATOR

(75) Inventors: Mitsuru Morotome, Nara (JP); Hiroyuki Yoshida, Osaka (JP); Atsushi Irie, Osaka (JP); Mizuki Yamauchi, Osaka (JP)

(73) Assignees: Toyo Shutter Co., Ltd., Osaka (JP); Fujitec Co., Ltd., Osaka (JP)

( * ) Notice: Subject to any disclaimer, the term of this patent is extended or adjusted under 35 U.S.C. 154(b) by 0 days.

(21) Appl. No.: 10/513,329

(22) PCT Filed: May 12, 2003

(86) PCT No.: PCT/JP03/05862

§ 371 (c)(1),
(2), (4) Date: Aug. 18, 2005

(87) PCT Pub. No.: WO03/095351

PCT Pub. Date: Nov. 20, 2003

(65) Prior Publication Data

US 2006/0175147 A1 Aug. 10, 2006

(30) Foreign Application Priority Data

| | | |
|---|---|---|
| May 10, 2002 | (JP) | 2002-136046 |
| Jun. 13, 2002 | (JP) | 2002-173302 |
| Jun. 26, 2002 | (JP) | 2002-185695 |
| Aug. 23, 2002 | (JP) | 2002-242798 |
| Apr. 25, 2003 | (JP) | 2003-122557 |

(51) Int. Cl.
*B66B 13/28* (2006.01)
*E06B 7/16* (2006.01)

(52) U.S. Cl. ..... 187/400; 49/475.1; 49/484.1

(58) Field of Classification Search ..... 187/400; 49/475.1, 489.1, 484.1; 277/644, 647, 649, 277/650, 930, 931, 933
See application file for complete search history.

(56) References Cited

U.S. PATENT DOCUMENTS 1,406,951 A * 2/1922 Fehr ..... 187/400
3,024,504 A * 3/1962 Miller ..... 49/489.1

(Continued)

FOREIGN PATENT DOCUMENTS

JP 50-79184 7/1975

(Continued)

*Primary Examiner*—Peter M Cuomo
*Assistant Examiner*—Eric Pico
(74) *Attorney, Agent, or Firm*—Kratz, Quintos & Hanson, LLP

(57) ABSTRACT

In an elevator comprising an entrance frame provided on an entrance leading from a landing hall to a hoistway and having an upper frame (103) and a vertical frame (102, 102), and landing doors (110, 110) arranged on the entrance frame with a gap and to be guided by a sill (104) for opening-closing an opening of the entrance frame, the landing doors (110, 110) have smoke shielding members (120, 130, 111) which are provided on a top portion, side portion, and a bottom portion of the landing doors (110, 110) for preventing the infiltration of smoke. The smoke shielding member (130) on the side portion is in contact with the smoke shielding member (111) on the bottom portion at a lower position, and is in contact with the smoke shielding member (120) on the top portion at an upper position.

17 Claims, 45 Drawing Sheets

U.S. PATENT DOCUMENTS

| | | | | | |
|---|---|---|---|---|---|
| 3,504,456 | A | * | 4/1970 | Claud, Jr. | 49/470 |
| 4,058,191 | A | | 11/1977 | Balbo | 187/1 R |
| 4,823,509 | A | * | 4/1989 | Ando | 49/303 |
| 5,377,784 | A | * | 1/1995 | Walkowiak et al. | 187/336 |
| 5,794,745 | A | * | 8/1998 | Gore | 187/333 |
| 5,836,424 | A | * | 11/1998 | Allen | 187/333 |
| 5,899,303 | A | * | 5/1999 | Allen | 187/333 |
| 2006/0191749 | A1 | * | 8/2006 | Sasaki et al. | 187/391 |

FOREIGN PATENT DOCUMENTS

| | | | | |
|---|---|---|---|---|
| JP | 54-49066 | | | 4/1979 |
| JP | 62-47588 | | | 3/1987 |
| JP | 63-112389 | | | 5/1988 |
| JP | 3-111394 | | | 5/1991 |
| JP | 4-153190 | | | 5/1992 |
| JP | 5-338975 | | | 12/1993 |
| JP | 6-16515 | | | 3/1994 |
| JP | 6-72681 | | | 3/1994 |
| JP | 6-26530 | | | 7/1994 |
| JP | 6-234488 | | | 8/1994 |
| JP | 06-345366 | | | 12/1994 |
| JP | 7-33373 | | | 2/1995 |
| JP | 7-76477 | | | 3/1995 |
| JP | 7-206345 | | | 8/1995 |
| JP | 8-127485 | | | 5/1996 |
| JP | 8-165081 | | | 6/1996 |
| JP | 08165081 | A | * | 6/1996 |
| JP | 8-239185 | | | 9/1996 |
| JP | 08-259153 | | | 10/1996 |
| JP | 11-503992 | | | 4/1999 |
| JP | 2004196451 | A | * | 7/2004 |
| JP | 2004323222 | A | * | 11/2004 |
| WO | WO 98/22381 | A1 | | 5/1998 |

* cited by examiner (b)

(a)

DOOR DEVICE OF ELEVATOR

TECHNICAL FIELD

The present invention relates to the improvement of a door unit for preventing smoke from passing through a landing entrance of an elevator into a hoistway or vice versa. "The infiltration of smoke" hereinafter means one of the passage of smoke through the landing entrance into the hoistway and the passage of smoke through the hoistway into the landing entrance, or both of these.

BACKGROUND ART

The conventional unit is proposed in FIGS. 3 to 5. FIG. 3 is a front view of the conventional door unit for an elevator. FIG. 4 is a view on arrow A-A shown in FIG. 3. FIG. 5 is a view on arrow B-B shown in FIG. 3.

With reference to the drawings described above, the numeral 101 indicates a landing door to be opened in opposite directions at an elevator landing entrance, 102 is a vertical frame of the entrance, 103 is an upper frame of the entrance, 104 is a sill. The vertical frame 102, the upper frame 103 and the sill 104 define an opening of the landing entrance. The numeral 105*a* indicates a smoke shielding member which is provided on a side portion of the door 101 and for closing a gap between the door 101 and the vertical frame 102, 105*b* is a smoke shielding member for closing a gap between the door 101 and the upper frame 103, 105*c* is a smoke shielding member which is inserted into a groove 104*a* of the sill 104 and for closing a gap thereof. The numeral 106 indicates a screw for mounting the smoke shielding members 105*a*, 105*b*, 105*c*.

With the door unit thus constructed, the smoke shielding members 105*a*, 105*b*, 105*c* provided around the door 101 close gaps between the door and the entrance vertical frame 102, between the door and the entrance upper frame 103, and between the door and the sill 104 when the door is closed, to thereby prevent smoke from flowing into a hoistway even in the event of a fire, whereby the smoke is not distributed to other floor levels through the hoistway (e.g., JP-U No. 79184/1975, JP-A No. 112389/1988).

With the conventional unit, the smoke shielding members 105*a*, 105*b*, 105*c* are always in contact with members opposed to the smoke shielding members, so that the smoke shielding members are caused to wear with normally opening-closing the door, necessitating a proper maintenance work. Furthermore it is extremely difficult to smoothly open/close the landing door 101, to always cause trouble with sliding noise.

Furthermore there is a recent increase in the number of elevators having no machine room, i.e., elevators having equipments installed in the hoistway, such as a drive motor or a control panel to be a source of a fire, (so-called machine-roomless elevators). The interior of the building also becomes a source of fire when a fire breaks out. Therefore, there is a need to take measures for preventing properly the infiltration of smoke regardless of whether the smoke flow comes from the landing hall or from the hoistway. Furthermore, with the conventional unit, as shown in FIG. 6, three or more members are opposed, particularly, at a gap 107 between door stopping portions provided upward or downward of the landing doors 101 and at positions indicated by arrows in FIG. 18, so that it is indispensable to provide device to close the gaps for preventing properly the infiltration of smoke.

In view of the foregoing problems, an object of the present invention is to provide a door unit of an elevator having an excellent smoke shielding performance without causing trouble in a normal door opening-closing operation.

DISCLOSURE OF THE INVENTION

According to the present invention, in an elevator comprising an entrance frame provided on an entrance leading from a landing hall to a hoistway, having an upper frame and a vertical frame, and landing doors arranged with gaps between the entrance frame and the landing doors, to be guided by a sill for opening-closing an opening of the entrance frame, a smoke shielding member is provided, for preventing the infiltration of smoke, on at least one of a top portion of the landing doors and a member opposed to the top portion of the landing doors, on at least one of a side portion of the landing doors and a member opposed to the side portion of the landing doors, and on at least one of a bottom portion of the landing doors and a member opposed to the bottom portion of the landing doors.

Further according to the present invention, in an elevator comprising an entrance frame provided on an entrance leading from a landing hall to a hoistway, having an upper frame and a vertical frame, and landing doors arranged with gaps between the entrance frame and the landing doors, to be guided by a sill for opening-closing an opening of the entrance frame and having a high-speed door and a low-speed door, a smoke shielding member is provided, for preventing the infiltration of smoke, on at least one of a top portion of the high-speed door and the low-speed door and a member opposed to the top portion of the high-speed door and the low-speed door, on at least one of a side portion of the high-speed door and the low-speed door and a member opposed to the side portion of the high-speed door and the low-speed door, and on at least one of a bottom portion of the high-speed door and the low-speed door and a member opposed to the bottom portion of the high-speed door and the low-speed door.

BEST MODE FOR CARRYING OUT THE INVENTION

First Embodiment

With reference to the drawings, a first embodiment of a door unit of an elevator of the present invention will be described below.

Figure 1:
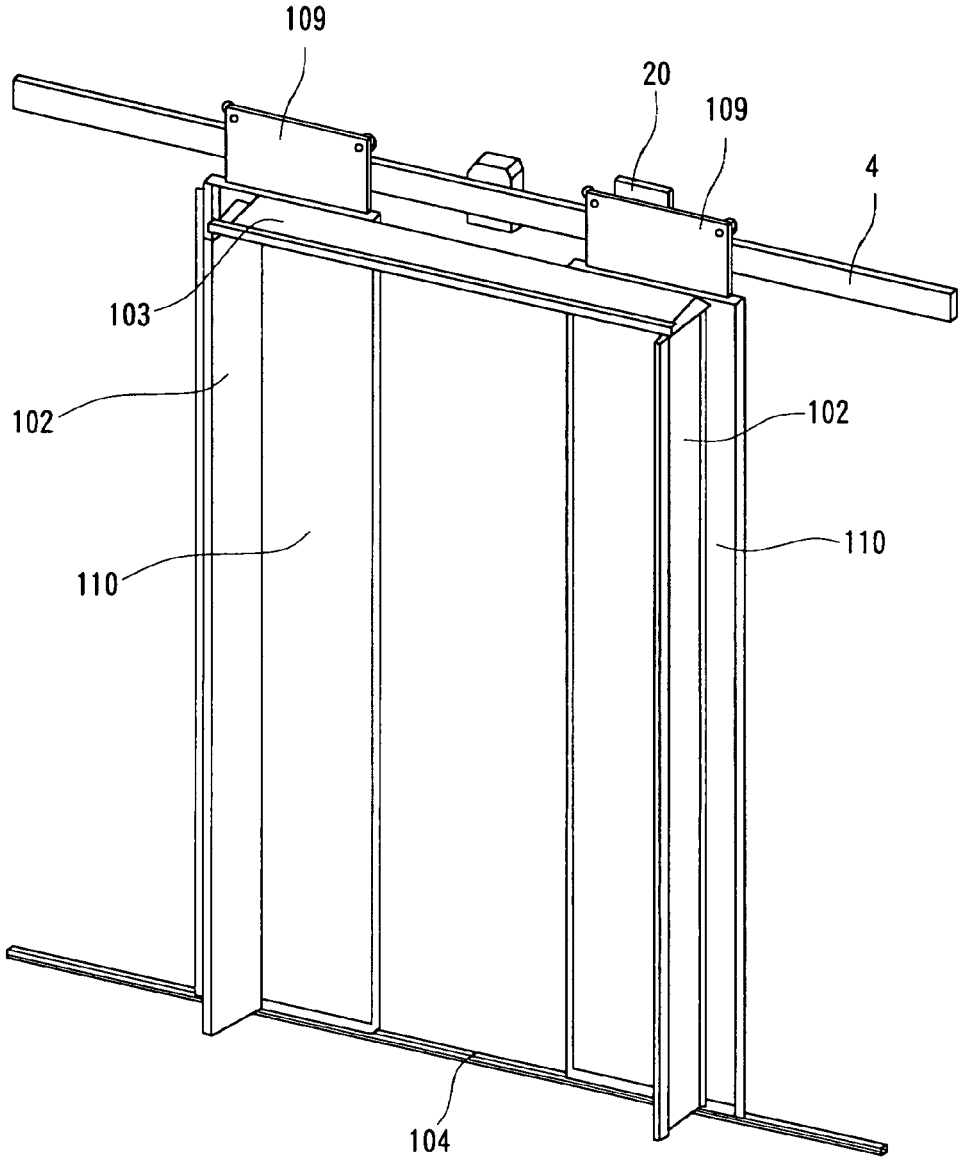
FIG. 1 is a perspective view showing an overall structure of a door unit of an elevator.

As seen in FIG. 1, an elevator comprises an upper frame 103 and a pair of opposite vertical frames 102, 102 which define an opening leading from a landing to a hoistway. The opening is provided with a pair of opposite landing doors 110, 110 which are opened laterally from the center. The doors 110, 110 are hung on a pair of hangers 109, 109 reciprocally movably engaged with a rail 4. A sill 104 is provided on a lower edge of the opening. Lower ends of the doors 110, 110 are slidably fitted into the sill 104.

Figure 2:
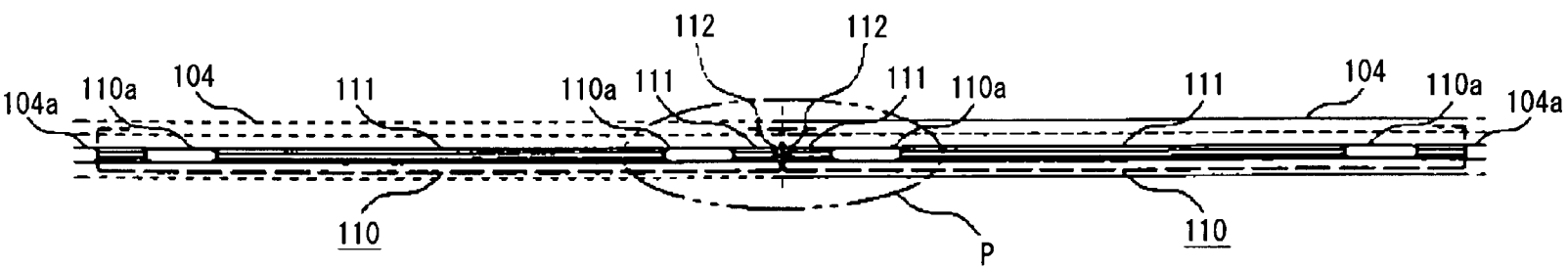
FIG. 2 is a plan view showing a first embodiment of the door unit embodying the present invention.
Figure 3:
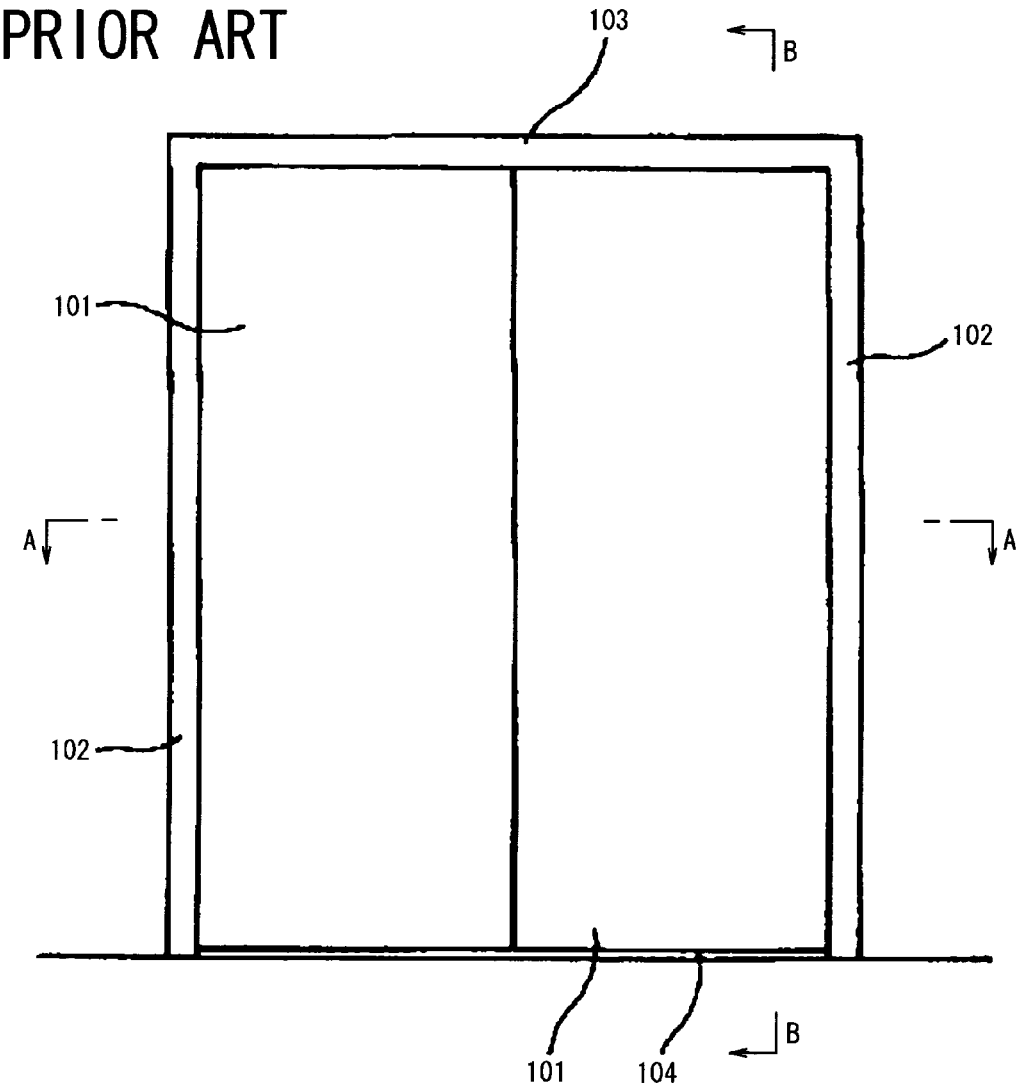
FIG. 3 PRIOR ART
FIG. 3 is a front view of a smoke-shielding landing door unit for use in the conventional elevator.
Figure 4:
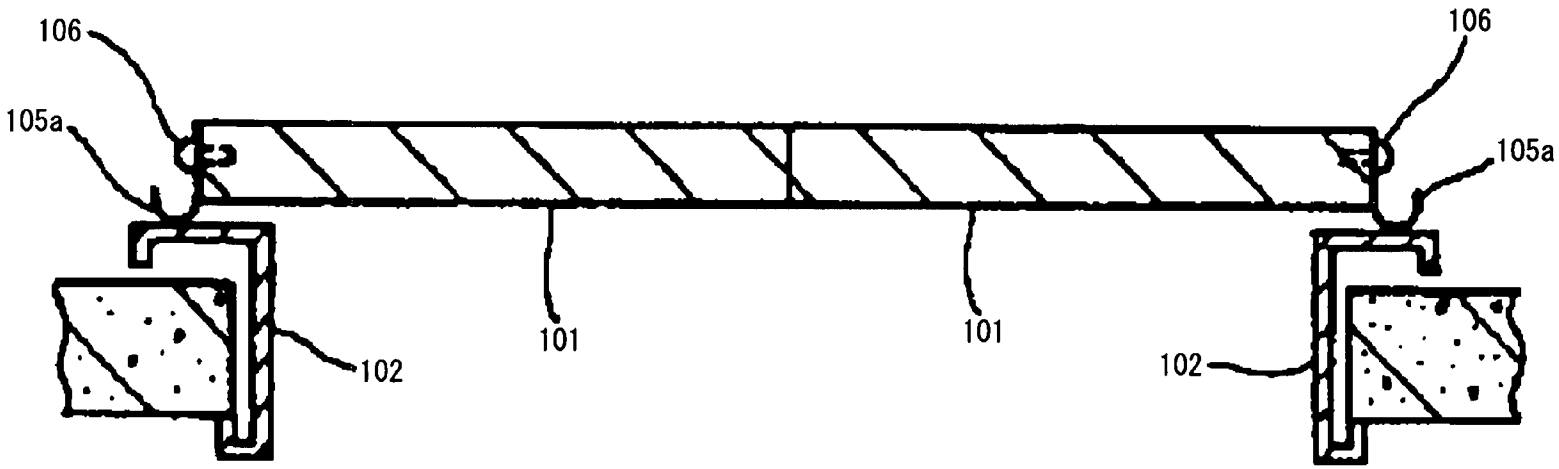
FIG. 4 PRIOR ART
FIG. 4 is a view on arrow A-A shown in FIG. 3.
Figure 5:
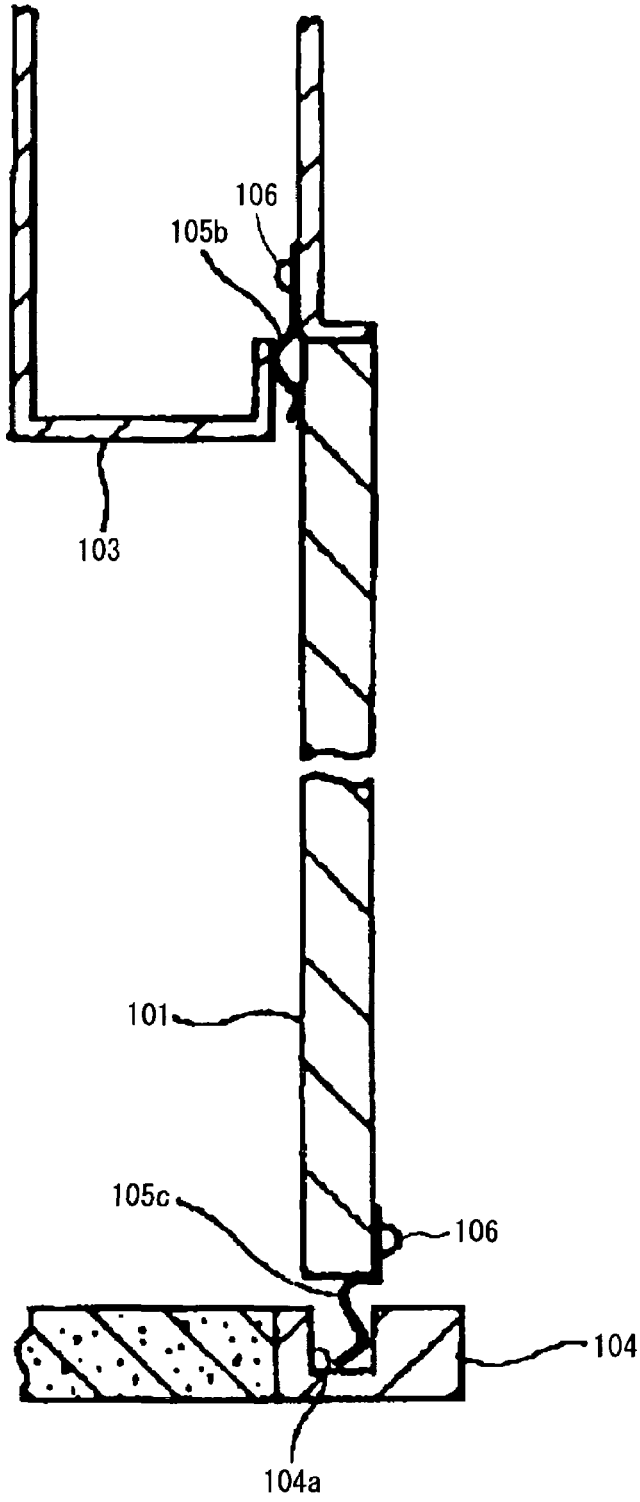
FIG. 5 PRIOR ART
FIG. 5 is a view on arrow B-B shown in FIG. 3.
Figure 6:
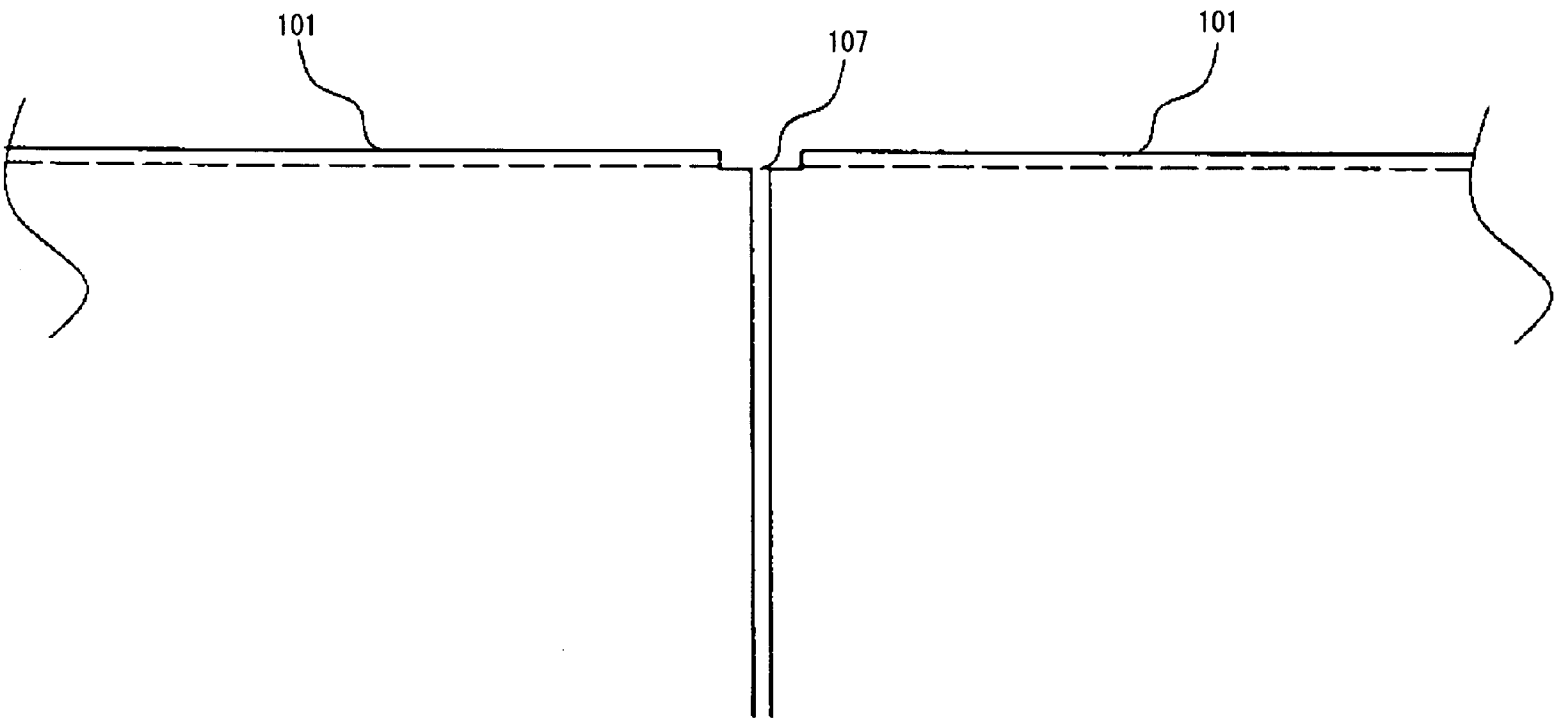
FIG. 6 PRIOR ART
FIG. 6 is a diagram for describing the problems of the conventional technology.
Figure 7:
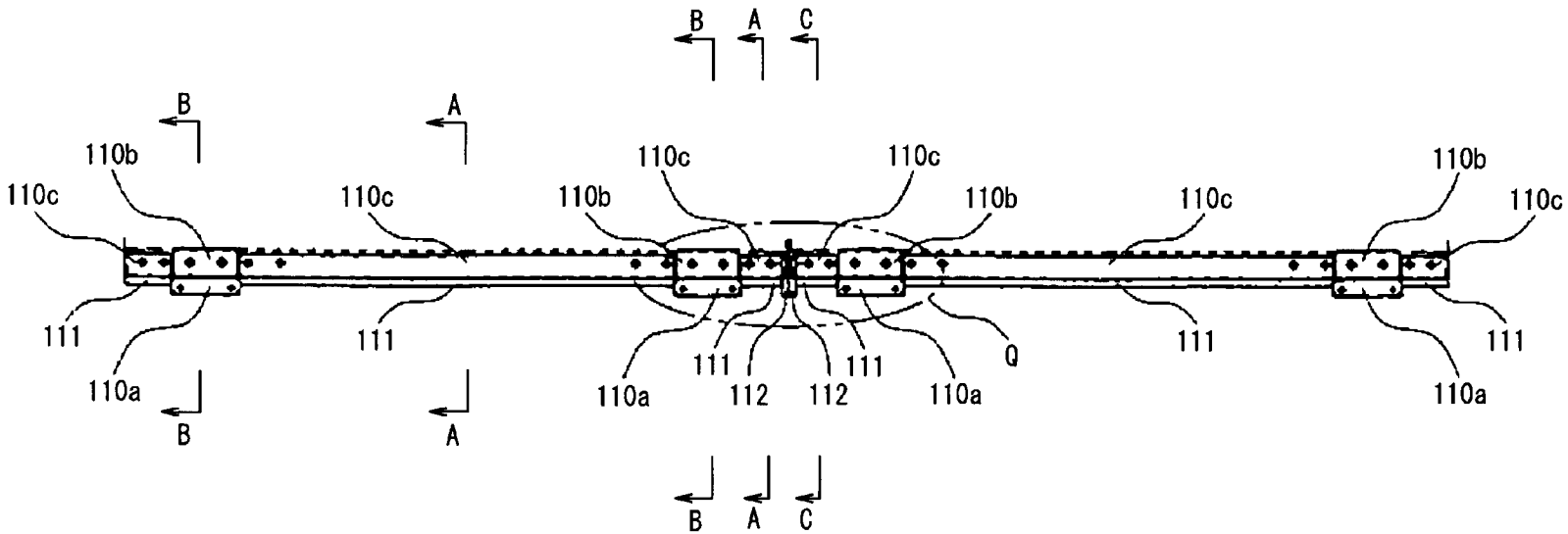
FIG. 7 is a fragmentary front view of the lower door unit shown in FIG. 2.
Figure 8:
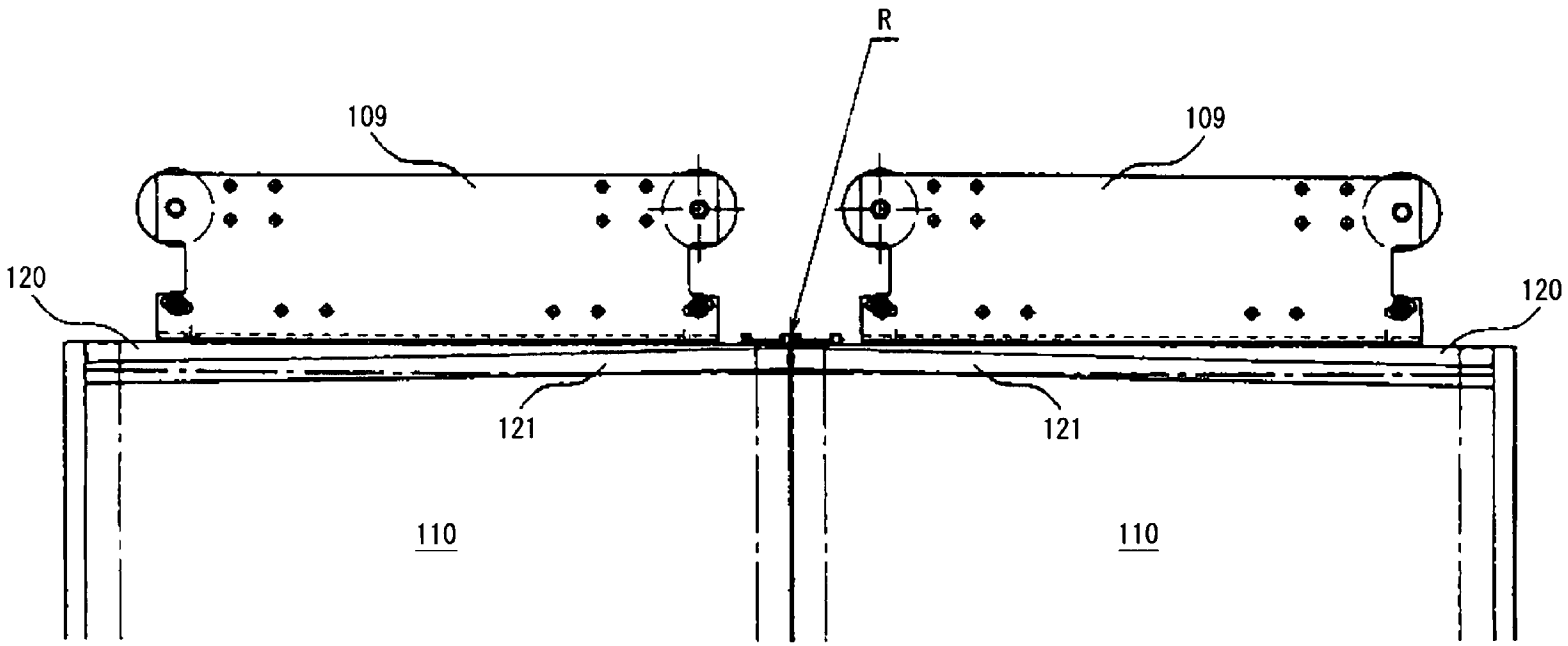
FIG. 8 is a fragmentary front view of the upper door unit shown in FIG. 7.
Figure 9:
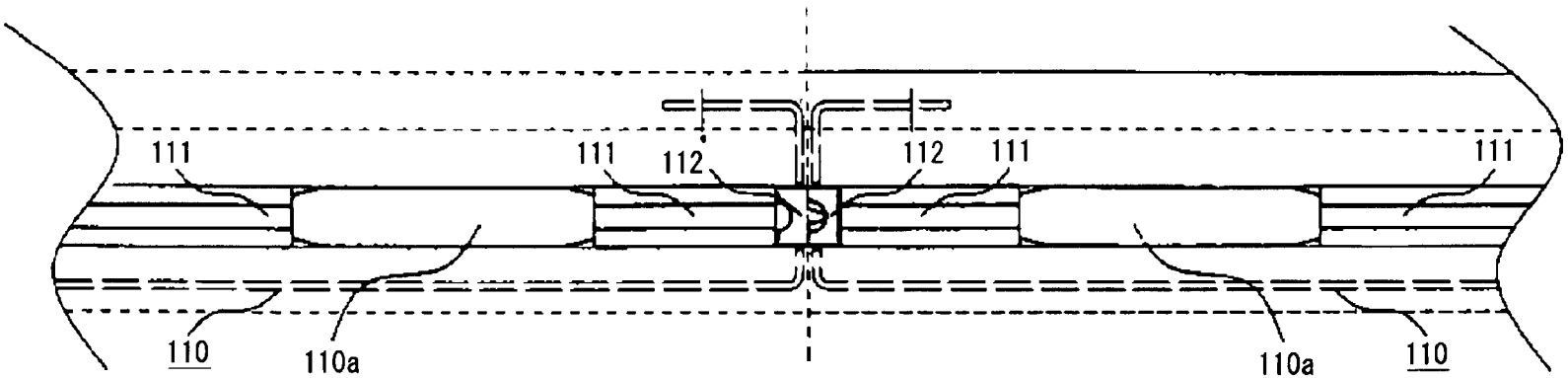
FIG. 9 is an enlarged view of a P-portion shown in FIG. 2.
Figure 10:
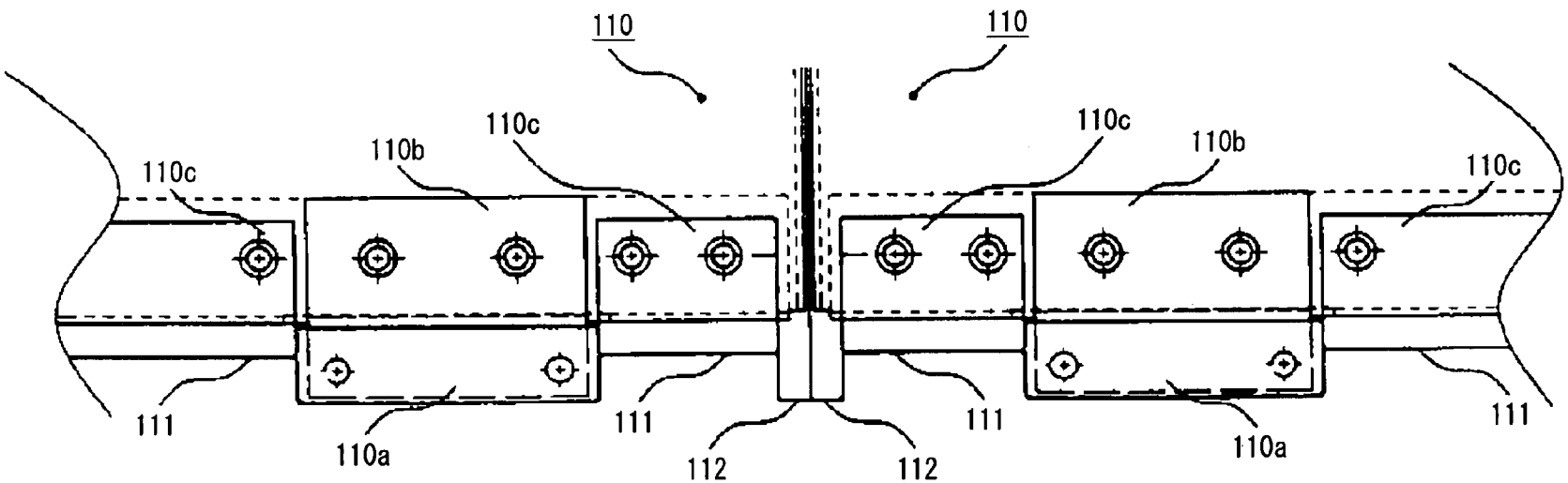
FIG. 10 is an enlarged view of a Q-portion shown in FIG. 7.
Figure 11:
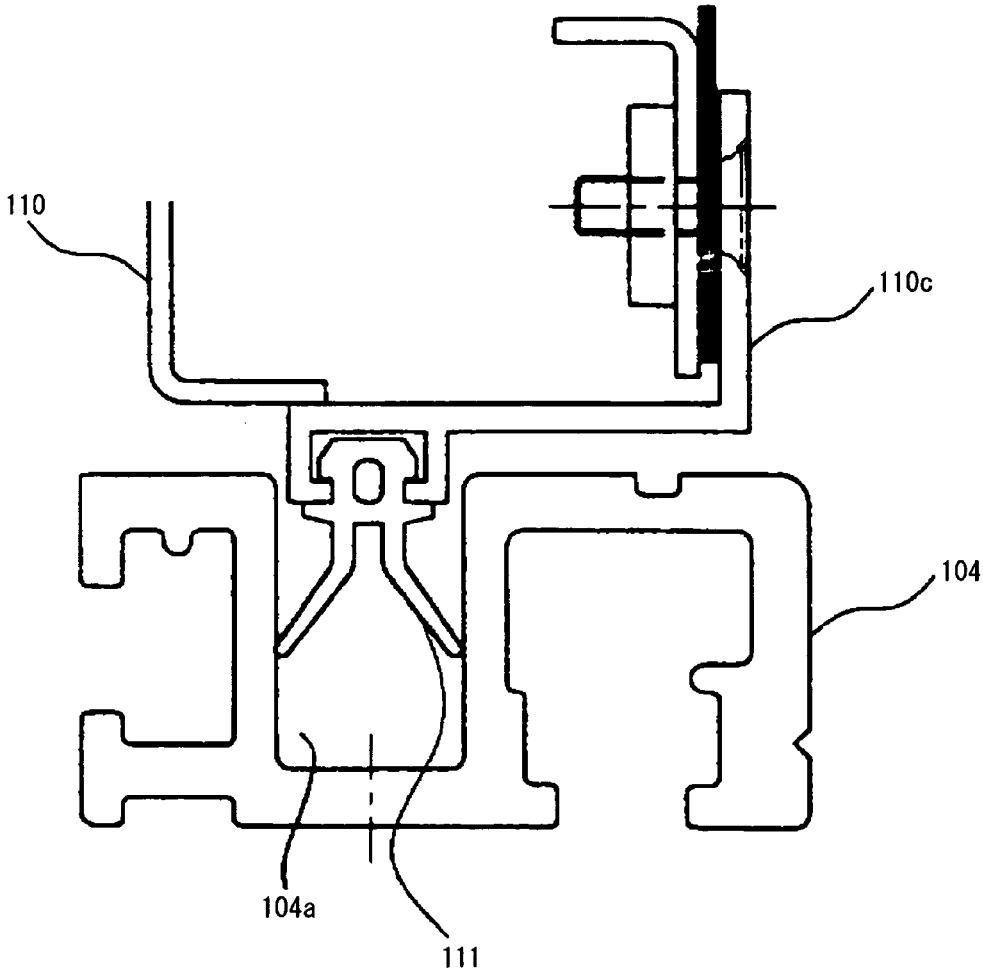
FIG. 11 is a view on arrow A-A shown in FIG. 7.
Figure 12:
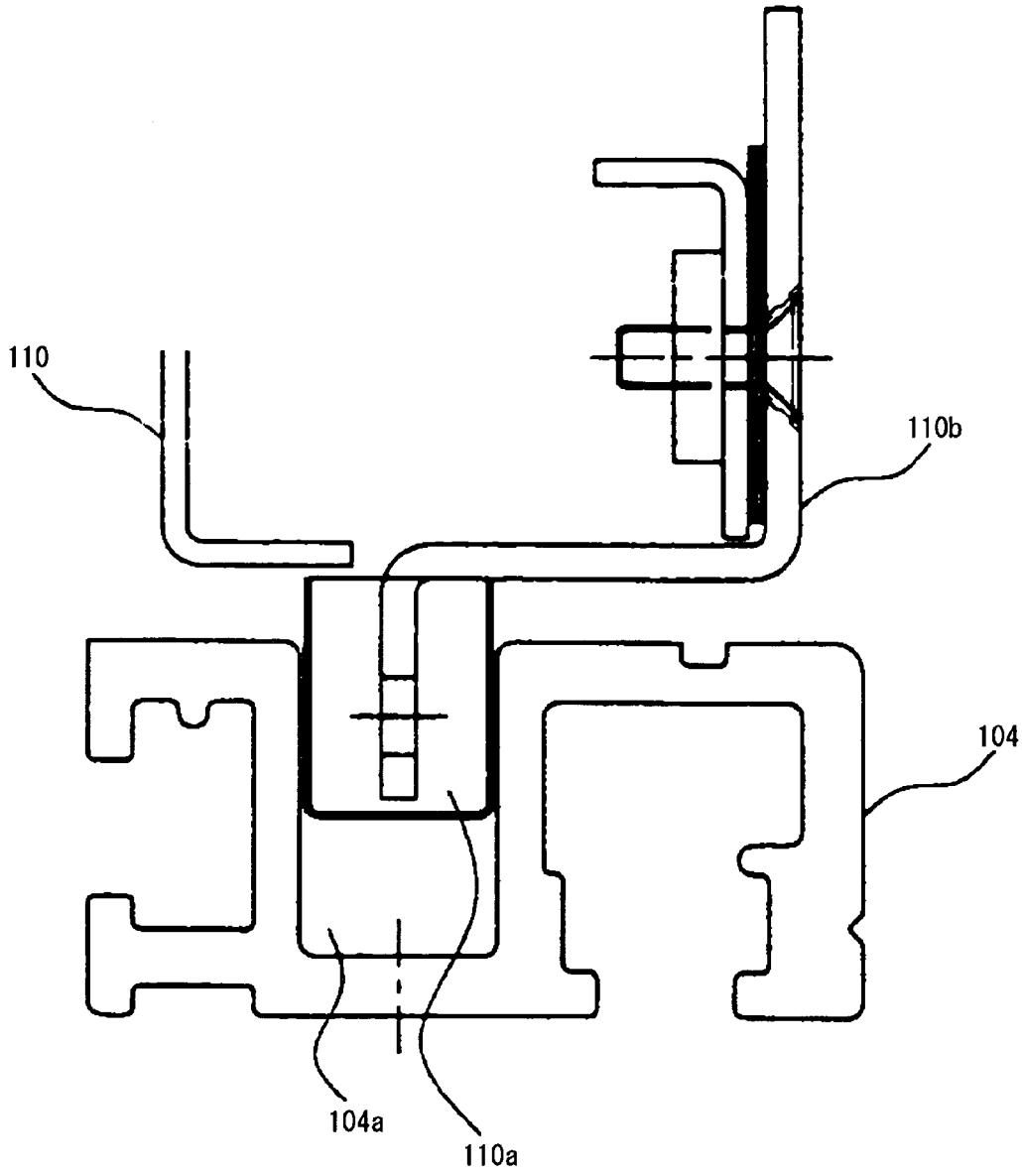
FIG. 12 is a view on arrow B-B shown in FIG. 7.
Figure 13:
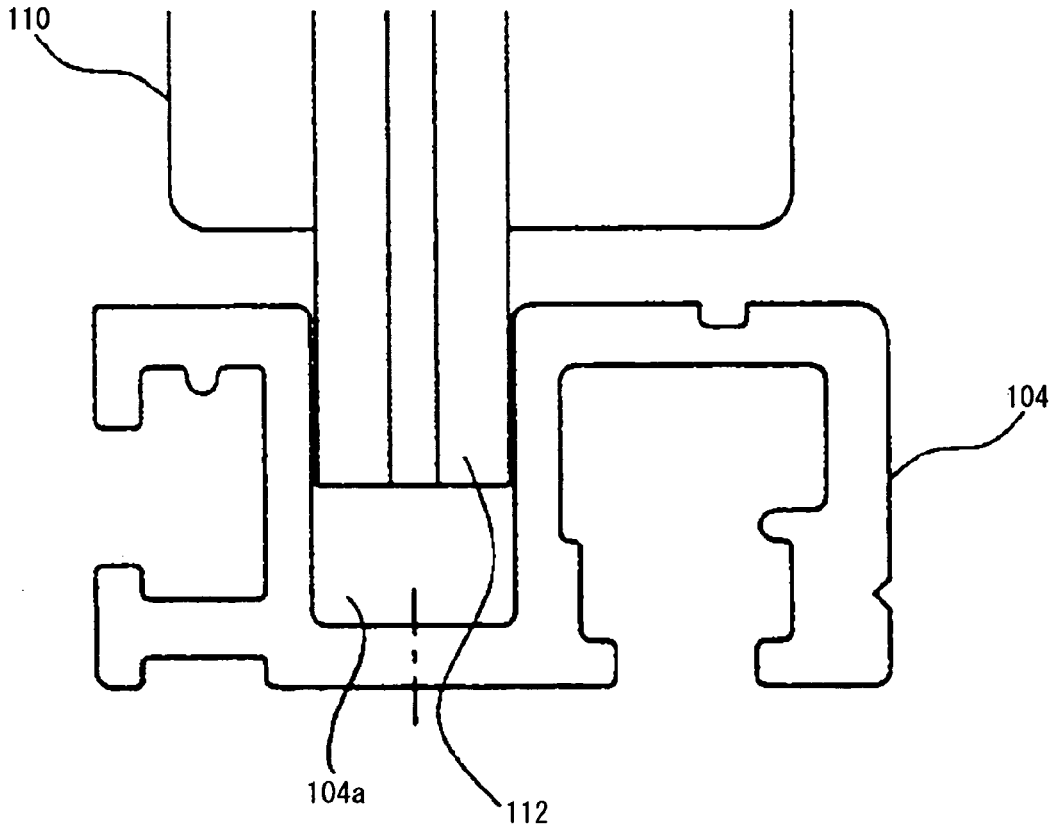
FIG. 13 is a view on arrow C-C shown in FIG. 7.
Figure 14:
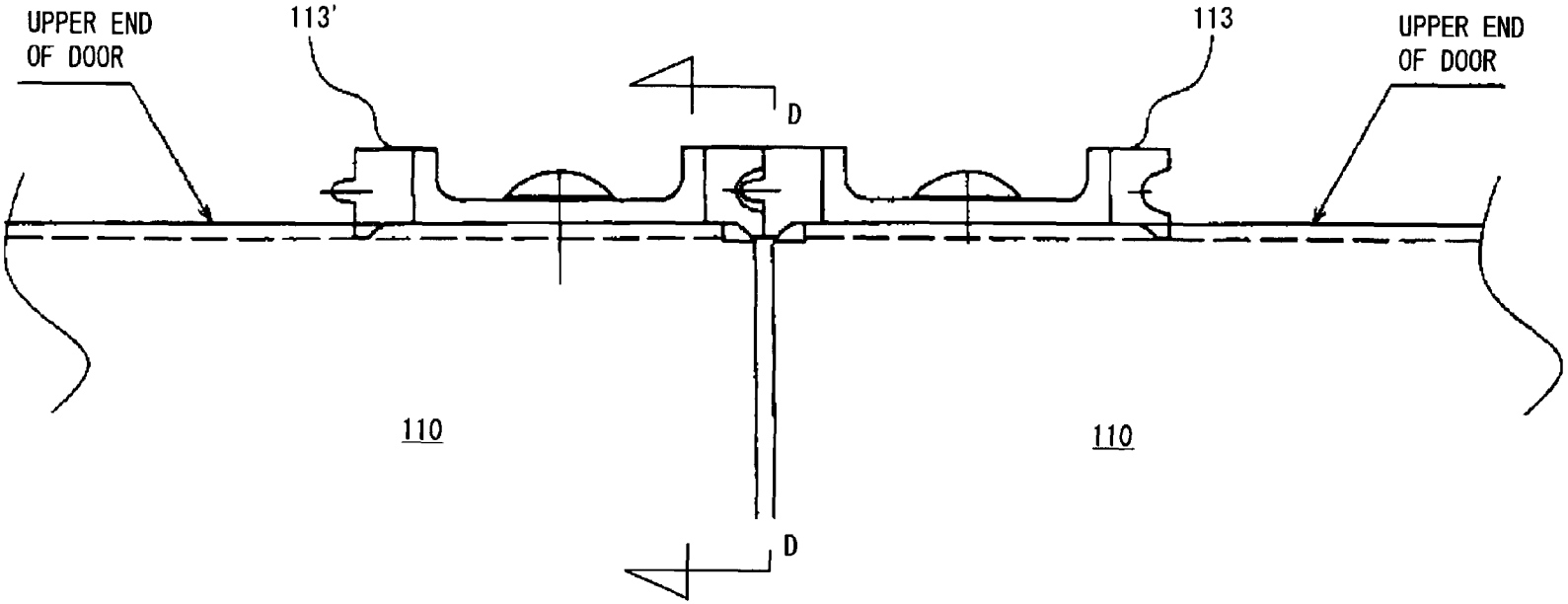
FIG. 14 is an enlarged view of an R-portion shown in FIG. 8.
Figure 15:
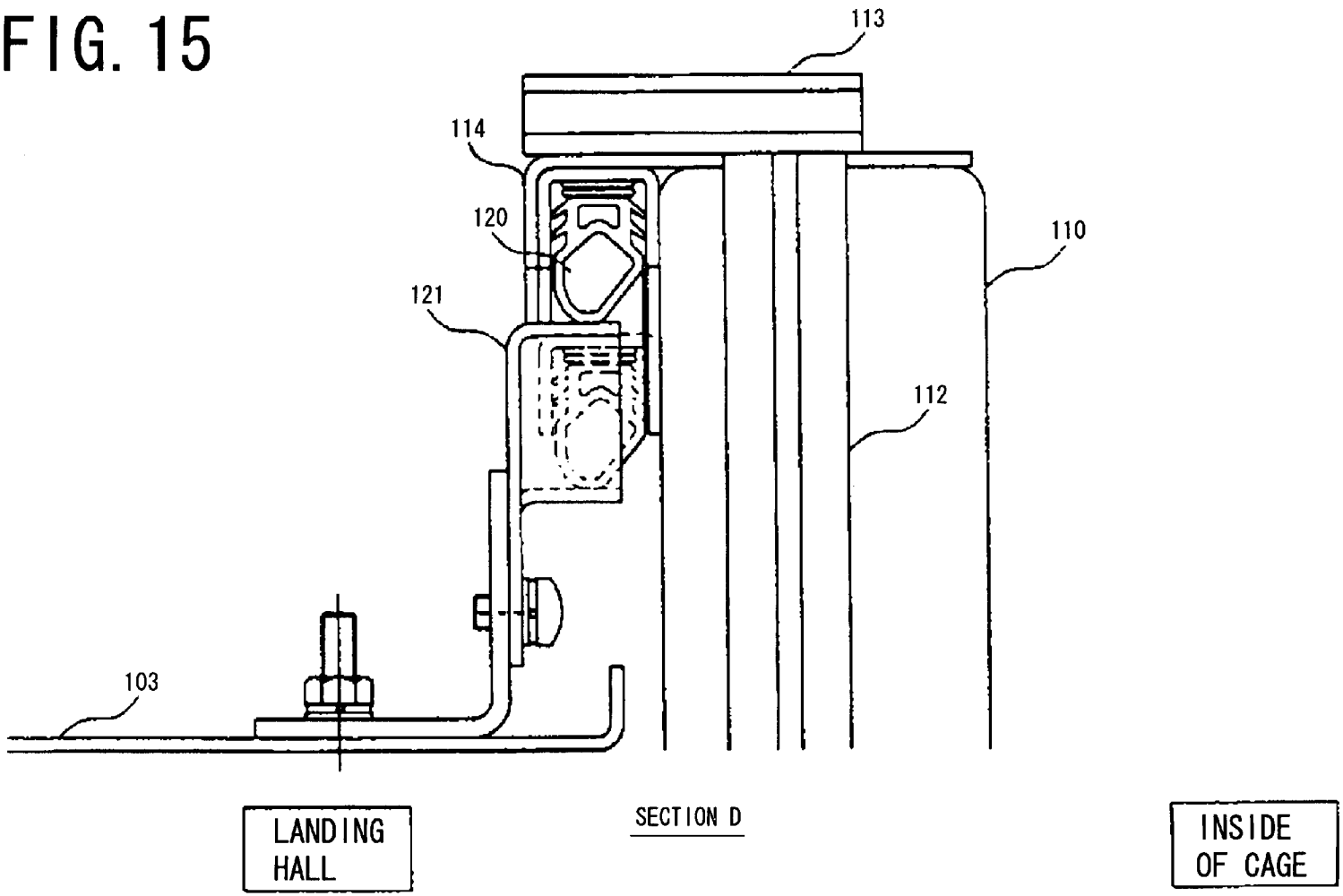
FIG. 15 is a view on arrow D-D shown in FIG. 14.
Figure 16:
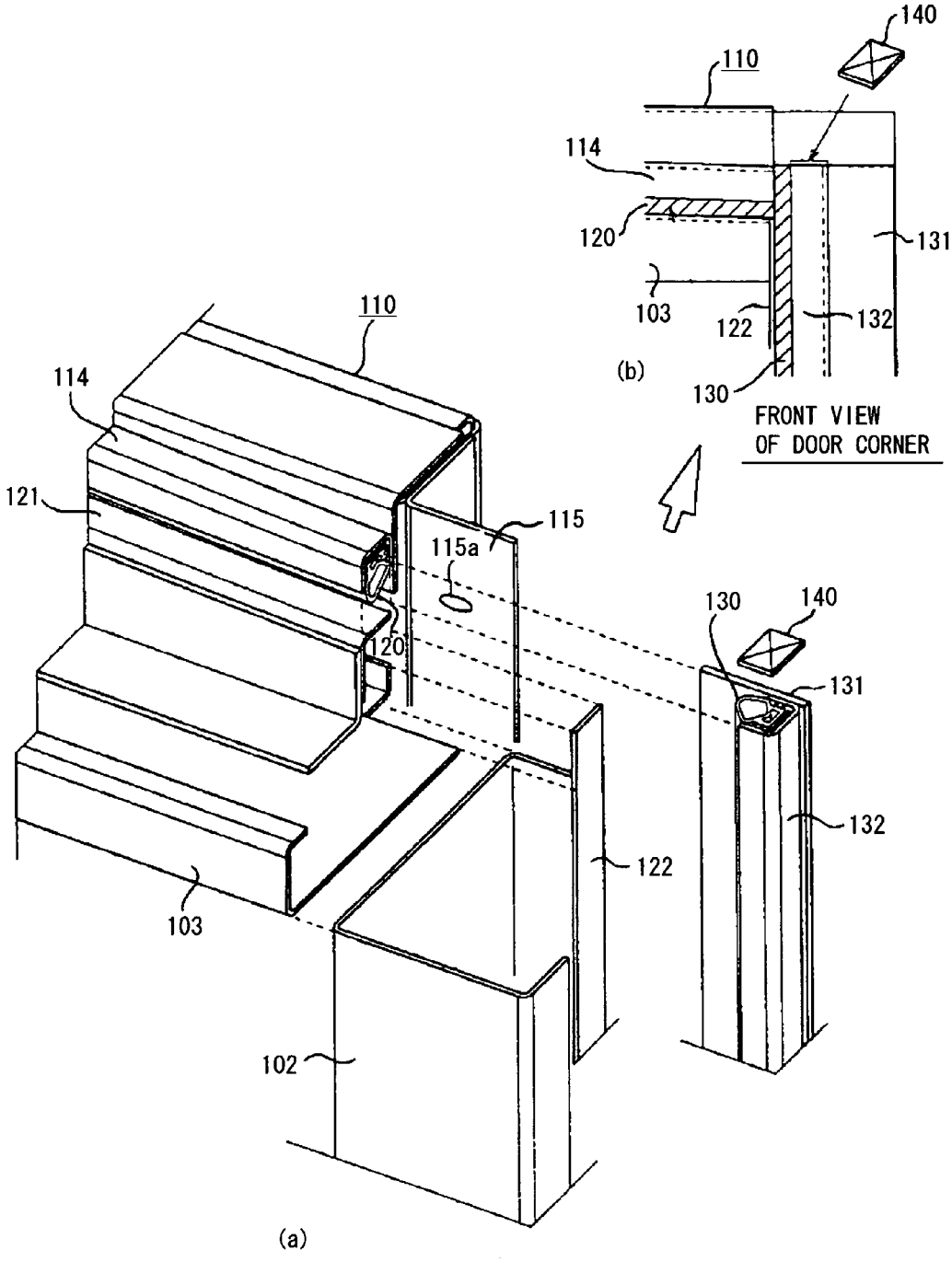
FIG. 16 is an enlarged exploded perspective view and a fragmentary front view illustrating the relationship among the landing door, vertical frame and the upper frame.

FIG. 2 is a perspective plan view showing the door unit of the present embodiment. FIG. 7 is a fragmentary front view of the lower door unit shown in FIG. 2. FIG. 8 is an upper fragmentary front view of the door unit shown in FIG. 7. FIG. 9 is an enlarged view of a P-portion shown in FIG. 2. FIG. 10 is an enlarged view of a Q-portion shown in FIG. 7. FIG. 11 is a view on arrow A-A shown in FIG. 7. FIG. 12 is a view on arrow B-B shown in FIG. 7. FIG. 13 is a view on arrow C-C shown in FIG. 7. FIG. 14 is an enlarged view of an R-portion shown in FIG. 8. FIG. 15 is a view on arrow D-D shown in FIG. 14. FIG. 16 is an enlarged exploded perspective view and a fragmentary front view illustrating the relationship between the landing door 110 and vertical frame 102.

In FIGS. 3 to 6, like parts are designated by like reference numerals or symbols. In FIG. 8, the numeral 110 indicates a door hung on a door hanger 109, 110*a* in FIGS. 2, 7, 9, 10 and 12 are guide shoes to be guided by a groove 104*a* of the sill 104 and which is attached to a bottom portion of the door 110 with a bracket 110*b* shown in FIG. 12. The numeral 111 in FIGS. 10 and 11 indicates smoke shielding members comprising a pair of projections spreading toward an outer end, for example, and made of fire retardant rubber. The smoke shielding members are attached to the bottom portion of the landing door 110 with a bracket 110*c* so as to be fitted into a recess portion, and are provided on portions besides the portions to which guide shoes 110*a* are attached. The landing door 110 is given a door-closing force by a weight at all times, as not illustrated but already known.

In FIGS. 10 and 13, the numerals 112, 112' indicate rubber door stoppers which are provided on a side portion of the landing doors 110 and further serve as smoke shielding members. The rubber door stopper so hangs downward as to be inserted into the groove 104*a* of the sill 104, i.e., the rubber door stopper hangs downward toward a position wherein the rubber door stopper covers an end of the smoke shielding member 111. The rubber door stoppers 112, 112' and the smoke shielding members 111 are so arranged as to be positioned on the same vertical plane, for example, and are arranged as contactable with each other. One of the rubber door stoppers 112, 112' is formed with a recess while the other is formed with a projection, for example, so that the two rubber door stoppers are firmly in intimate contact with each other when the landing doors 110 are closed. The two rubber door stoppers are therefore brought into contact with each other with no space therebetween.

The smoke shielding member 111 is bendable so that outer ends of a pair of its projections are not in contact with side walls of the groove 104*a* when the door is being opened or closed to thereby suppress the occurrence of wear at the outer ends of the smoke shielding member 111 when the door is normally being opened or closed. In the event of a fire, air in space on fire is thermally expanded to force out high-pressure air containing smoke through a bottom portion of the door. When the air flows into the smoke shielding member 11 provided on the bottom portion of the door, the projection of the smoke shielding member adjacent to a room not on fire is pressed against a side wall of the groove 104*a*, to thereby reliably ensure the sufficient airtightness in accordance with a direction of smoke flow. In this case when the landing doors 110 are closed, the rubber door stoppers 112, 112' and the smoke shielding members 111 are moderately in contact with each other by the door-closing force to thereby close a bottom gap with the aforementioned operational advantage. The smoke shielding member 111 can be formed so that the outer ends of a pair of projections are bent slightly inwardly. It is also possible to eliminate a hanging portion of the rubber door stoppers 112, 112' by moderately bringing the smoke shielding members 111 provided on the landing doors 110 into contact with each other when the right and left landing doors 110 are closed.

On the other hand, the numerals 113, 113' in FIG. 14 indicate smoke shielding members provided on upper ends of the landing doors 110. As in the same manner of the rubber door stoppers 112, 112', the smoke shielding members 113, 113' are brought into contact with each other with no space therebetween by forming a recess with one of the smoke shielding members 113, 113' and a projection with the other so that the two members are firmly in intimate contact with each other when the landing doors 110 are closed. The provision of the rubber door stoppers 112, 112' and the smoke shielding member 113 which is arranged on a position in contact with the rubber door stoppers 112, 112' reliably eliminates an upper gap when the landing doors 110 are closed. Accordingly, when the landing doors 110 are closed, the door closing force not only closes a gap between the landing doors 110, but moderately closes the gaps on the top and bottom portions. The structure leaving no space between any components is not limited to the embodiment wherein the projection is fitted into the recess, but various structures can be considered.

In FIGS. 8 and 15, the numeral 120 indicates, for example, a hollow smoke shielding member which is slopingly mounted on an upper end of the landing door 110 and which is removably inserted into a U-groove bracket 114. The smoke shielding member 120 is so arranged slopingly as to be positioned at a higher level as being away from the vertical frame 102. The numeral 121 indicates a stop board which is adjustable in a direction perpendicular to the upper frame 103. The stop board 121 is brought into contact with the smoke shielding member 120 when the landing door 110 is closed to close a gap therebetween. The stop board 121 is also so arranged slopingly as to be positioned at a higher level as being away from the vertical frame 2. It is possible to eliminate the smoke shielding members 113, 113' by the arrangement wherein the smoke shielding members 120 provided on the opposed landing doors 110 are in contact with each other when the pair of landing doors 110 are closed.

Next, FIG. 16(*a*) is an enlarged exploded perspective view showing the relationship among the landing door 110, the vertical frame 102 and the upper frame 103. FIG. 16(*b*) is a fragmentary front view of FIG. 16(*a*). The numeral 115 indicates an L-shaped bracket provided on the side portion of the landing door 110. A smoke shielding member 130 is removably inserted into a U-shaped groove bracket 132 provided on a bracket 131. The bracket 131 having the smoke shielding member 130 is attached to the bracket 115 as adjustable widthwise of the landing door 110 through a long hole 115*a*. Therefore the smoke shielding member 120 is always in contact with the smoke shielding member 130. The smoke shielding member 120 and the smoke shielding member 130 are most preferably provided on the same vertical plane. The numeral 122 indicates a bracket provided on the vertical frame 2 so that the bracket extends upwardly. The upper frame 103 is placed on the vertical frame 102 such that the upper frame 103 covers the vertical frame 102, so that the bracket 122 is so arranged as to cover a part of the side portion of the upper frame 103. The numeral 140 indicates a cover for covering an upper portion of the smoke shielding member 130. When the landing door 110 is being closed, the smoke shielding member 130 is pressed into contact with one surface of the bracket 122, whereby the provision of the smoke shielding member 120 and the smoke shielding member 130 properly closes a gap among the landing door 110, the vertical frame 102 and the upper frame 103.

Figure 19:
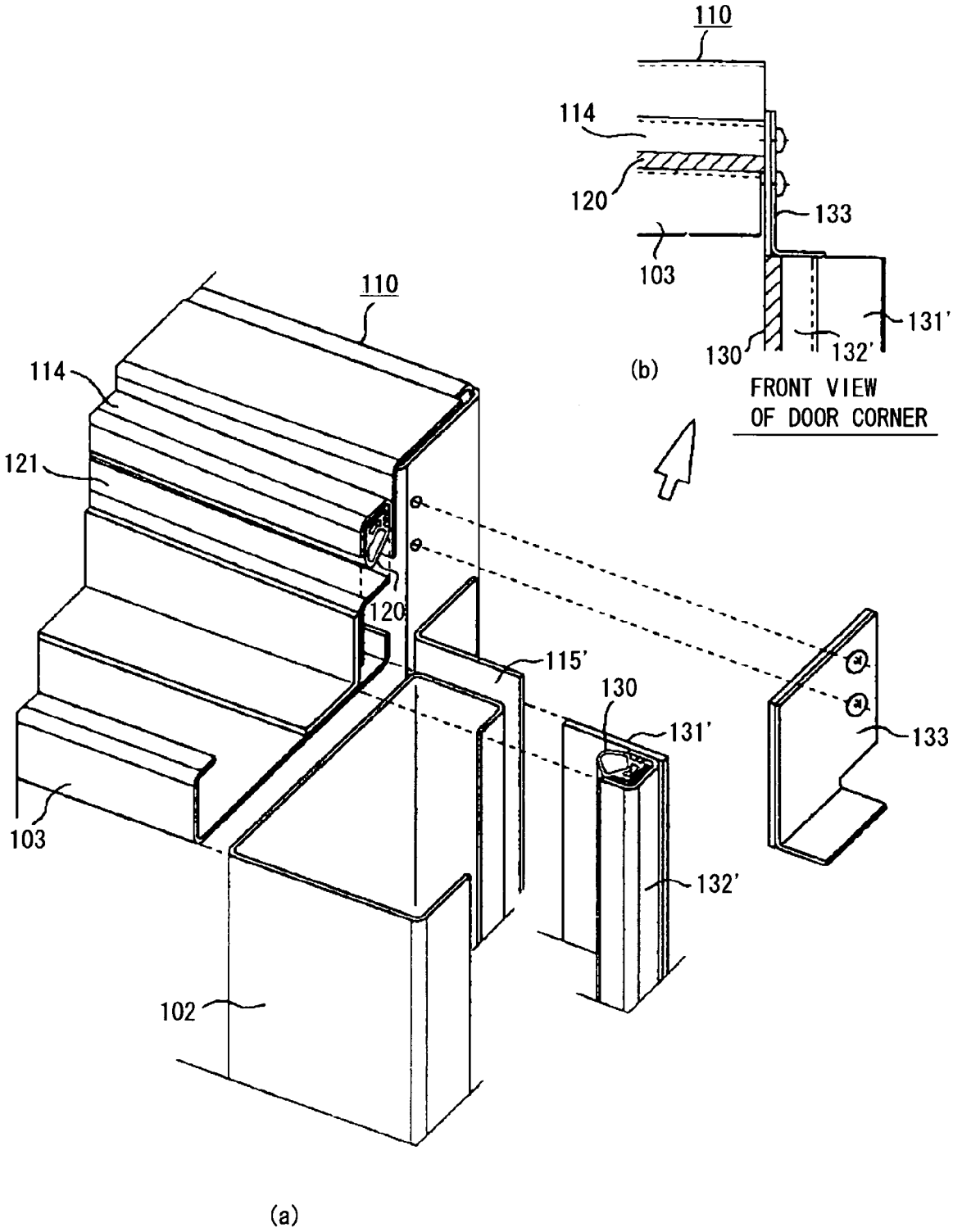
FIG. 19 is another enlarged exploded perspective view and another fragmentary front view illustrating the relationship among the landing door, vertical frame and the upper frame.

Taken as another example is an arrangement shown in FIG. 19. An L-shaped bracket 115', a bracket 131' and smoke shielding member 130 each merely has the same height level as that of the vertical frame 102, so that an L-shaped bracket 133 having rubber applied to its mounting surface and the bracket is arranged on the same plane as the smoke shielding member 120 and the smoke shielding member 130, covers simultaneously both the side of the upper frame 103 and the upper surface of the vertical frame 102 to thereby eliminate the gap.

Accordingly, when a pair of the landing doors 110 are closed, the gap between the vertical frame 102 and the landing door 110 is closed by the smoke shielding member 130, the gap between the upper frame 103 and the landing door 110 is closed by the smoke shielding member 120, the gap between the landing doors 110 is closed by the rubber door stopper 112, 112', the gap between the landing doors 110 and the sill 104 is closed by the smoke shielding member 111, the gap between the landing doors 110 and the sill 104 is closed by the smoke shielding member 111 and the rubber door stopper 112, 112', the gap between the landing doors 110 and the upper frame 103 is closed by the rubber door stopper 112, 112', and the smoke shielding member 113, 113' or the smoke shielding members 120. This can reliably prevent the passage of the smoke through a landing hall into the hoistway or through the hoistway into the landing hall.

The material and shape of the smoke shielding members 120, 130 and the smoke shielding member 111 should be determined in accordance with the respective roles, functions and characteristics. As to the smoke shielding member 130, a surface of the member 130 is merely pressed, so that only the smoke shielding performance should be fulfilled while the consideration of the movement with friction is not particularly required. On the other hand, as to the smoke shielding member 111, relative motion between the member 111 and the sill 104 always occurs with door opening-closing operation, so that there is a need to consider not only the smoke shielding performance but friction (including the problem of vibration and noise), and function for performing a smooth sliding operation is required. Furthermore, the smoke shielding member 120 is subject to friction due to relative motion between the stop board 121 and the member 120 just before the door is fully closed, so that the smoke shielding member 120 needs to have a function for performing a smooth sliding operation, although its smoothness is not as good as that of the smoke shielding member 111. Therefore, the smoke shielding member 120 desirably has both the smoke shielding performance and sliding performance.

In the event of a fire, temperature and pressure are particularly variable. Therefore it is effective that the members to be deformed due to the variations of temperature and pressure, e.g., the smoke shielding members 120, 130 are such that a hollow portion is slightly expanded, or said members, e.g., the smoke shielding member 111 are such that a pair of projections are deformed in accordance with a direction of smoke flow. Furthermore in addition to the case wherein the shape of the smoke shielding member is altered in accordance with pressures difference, the same effect can be obtained, for example, by the arrangement wherein the member (U-groove bracket, etc.) for supporting the smoke shielding member is movable. The specification on the smoke shielding performance provides that the smoke leakage be not greater than 0.2 $m^3/min \times m^2$ when pressure difference between opposite sides of the door is 19.6 Pa, so that complete smoke shielding performance is not required, and therefore the members are not necessarily in complete intimate contact with each other.

Figure 17:
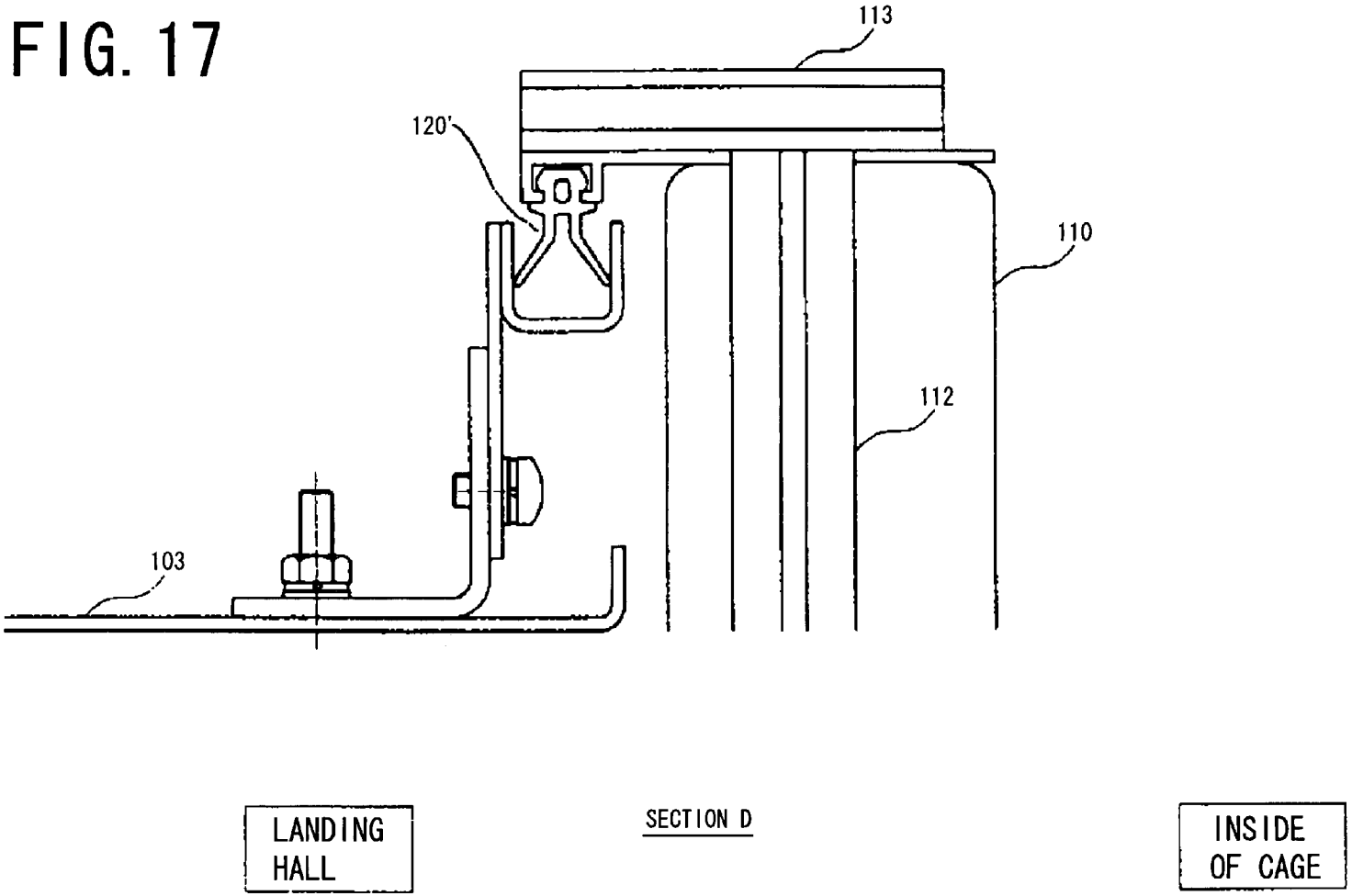
FIG. 17 is a view corresponding to FIG. 15 and showing another example of the present invention.
Figure 18:
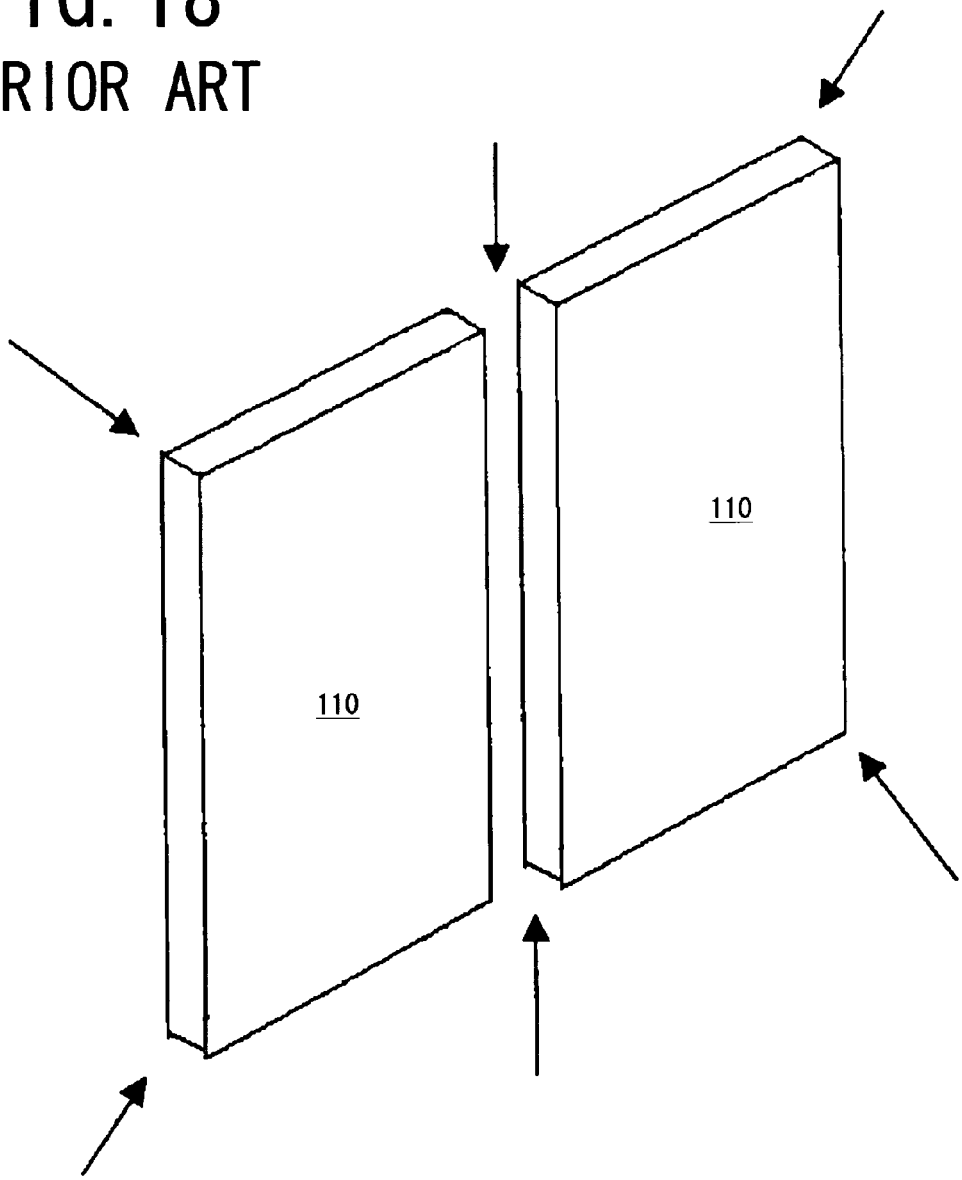
FIG. 18 PRIOR ART
FIG. 18 is a diagram for describing the problems of the conventional technology.

FIG. 17 shows the case wherein used as the smoke shielding member 120' is the same member as the smoke shielding member 111. Thus sharing parts as much as possible reduces the number of parts, hence convenience. However, in accordance with characteristics, roles, functions which the members are required to be provided with, materials and shapes can be suitably selected and determined.

Figure 20:
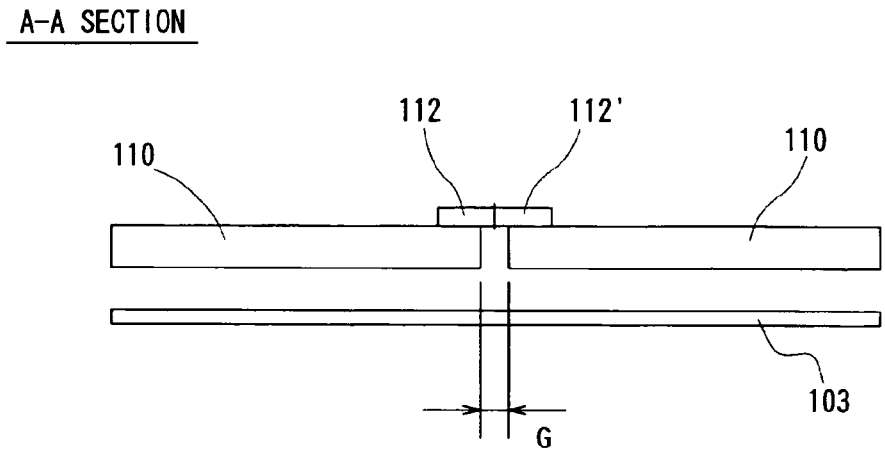
FIG. 20 is a plan view showing a gap between the door and the upper frame and a gap between the doors.
Figure 21:
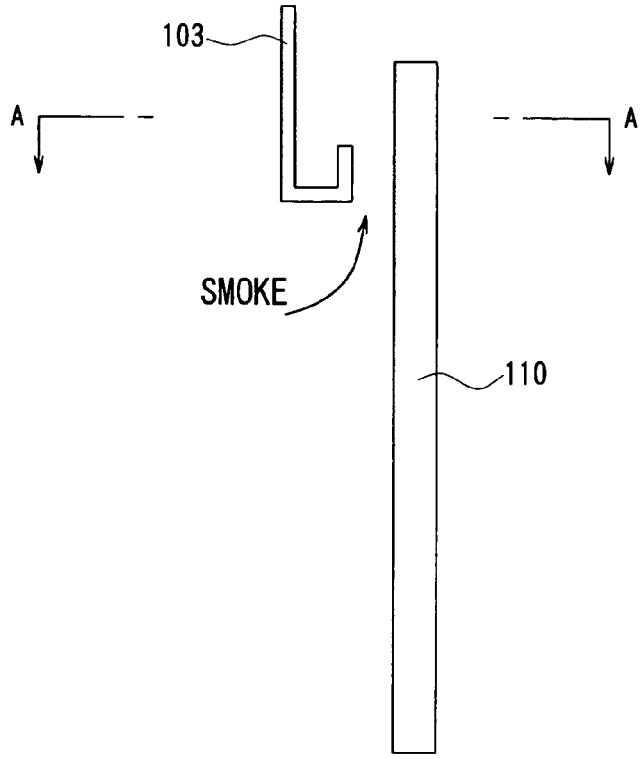
FIG. 21 is a side elevation showing a gap between the door and the upper frame.
Figure 22:
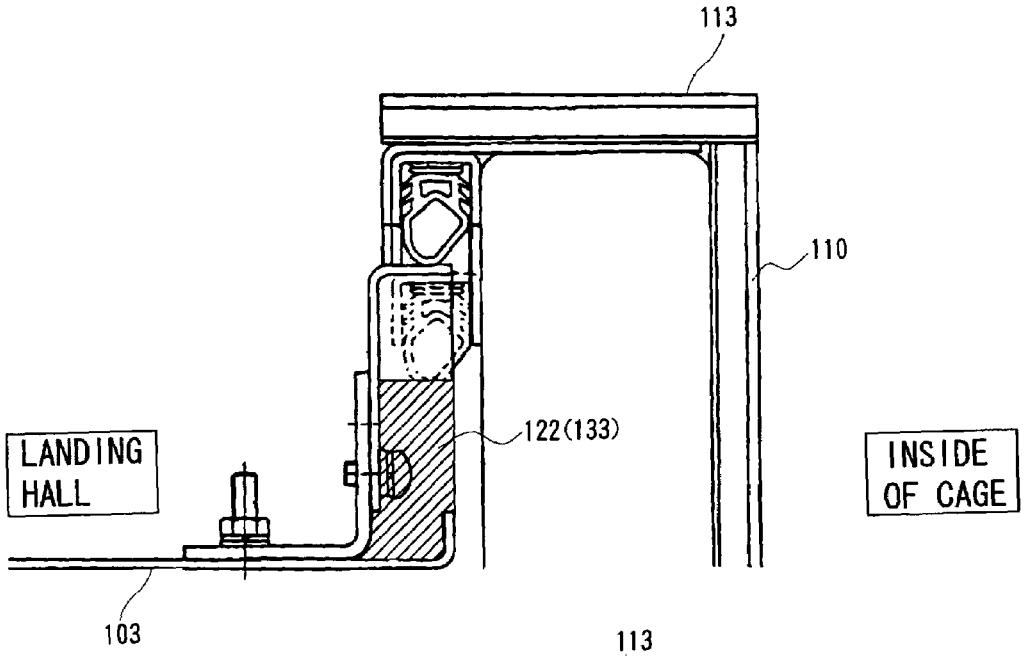
FIG. 22 is a side elevation illustrating a state wherein a smoke flowing path is closed by a bracket.
Figure 23:
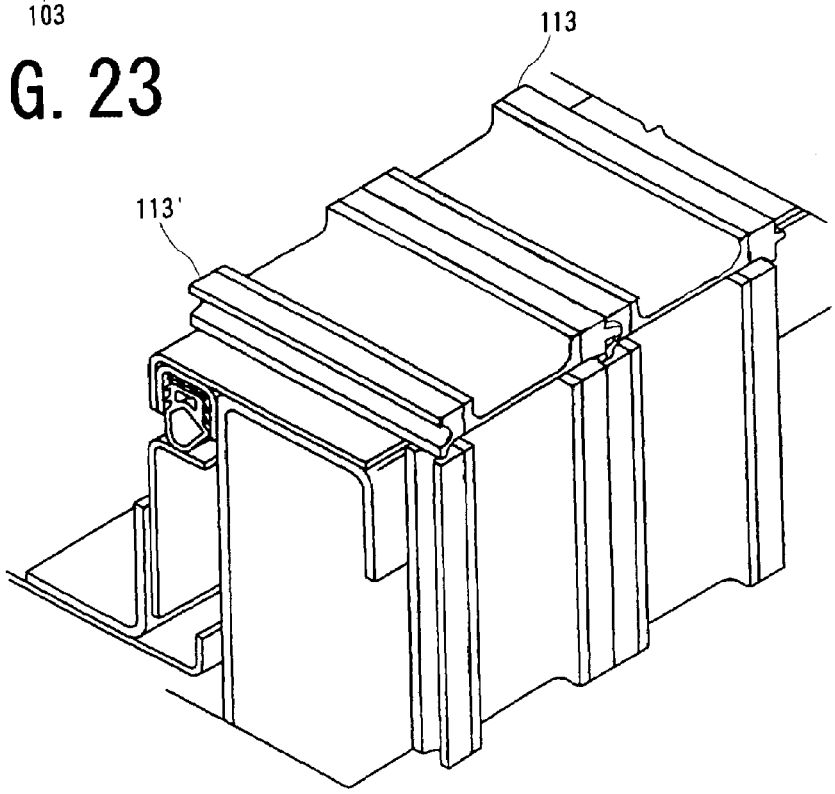
FIG. 23 is a perspective view illustrating a state wherein a gap between the doors is closed by the smoke shielding member.

With the first embodiment described, there exists a gap between the upper frame 103 and the door 110, as shown in FIGS. 20 and 21. Even if smoke is passed through the gap into a header, the brackets 122, 133 shown in FIGS. 16 and 19 block a smoke path indicated by hatching shown in FIG. 22 to prevent the smoke from passing therethrough horizontally. Furthermore, there exists a gap G (about 2 mm) between a pair of doors 110, 110, but the gap G is closed by the smoke shielding member 113, 113' shown in FIG. 23 to prevent smoke from flowing upwardly.

Further, with the first embodiment described, there is very few likelihood of interferences such as vibration or noise with usual opening-closing operation of the door. The door closed state reliably blocks the gap between the landing door and the entrance frame or between the landing door and the sill in accordance with the occasions, so that even if a fire breaks out at any time, the infiltration of smoke can be properly blocked. Furthermore there is no need to provide a special drive system or device for the function of smoke shielding and smoke prevention. The device of the present embodiment has an advantage of being additionally employed in existing elevators.

Second Embodiment

With reference to the drawings, a second embodiment of the present invention will be described below.

Figure 24:
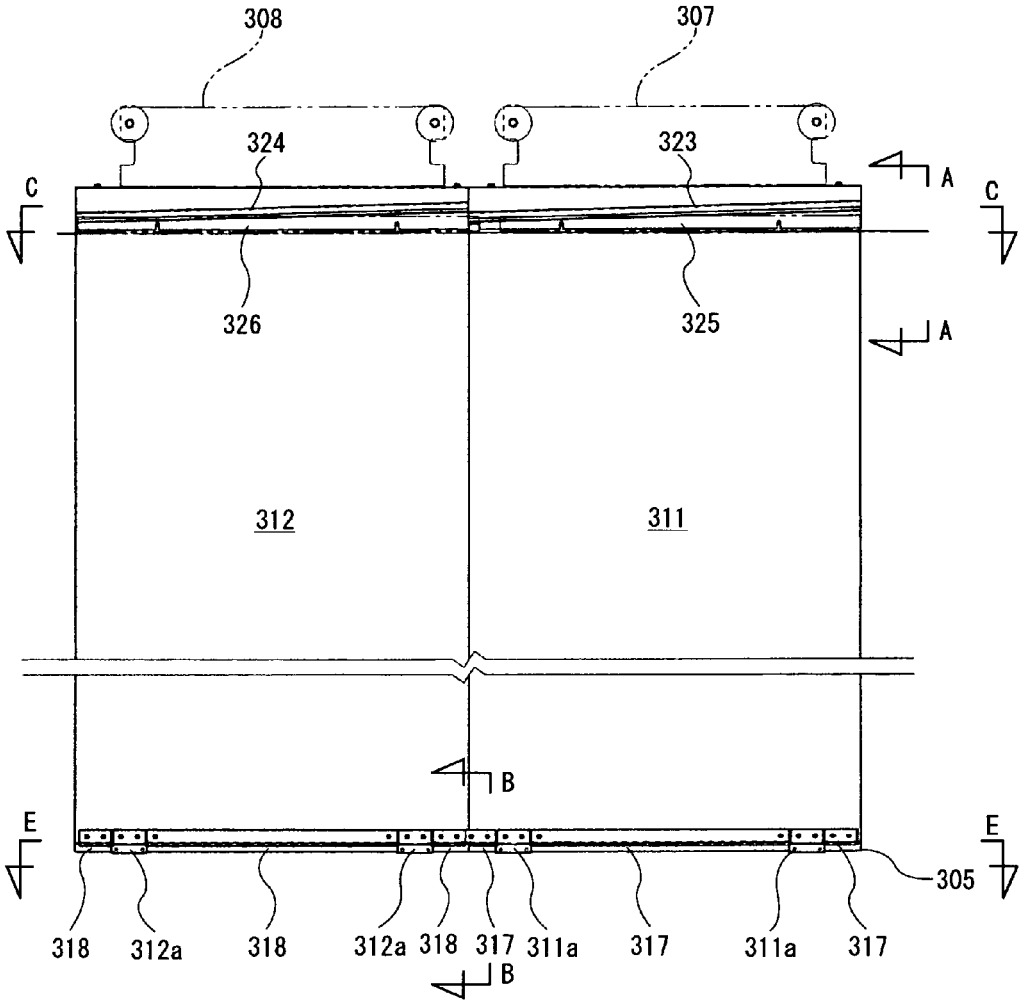
FIG. 24 is a front view showing a second example of the door unit embodying the present invention.
Figure 25:
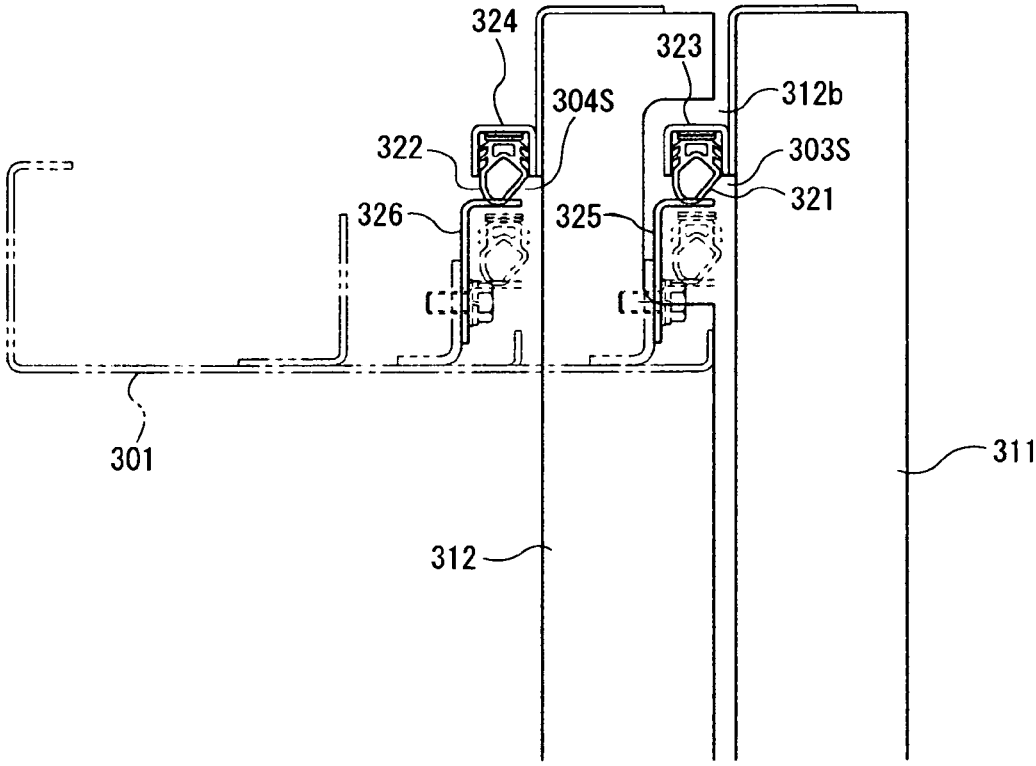
FIG. 25 is an enlarged view on arrow A-A shown in FIG. 24.
Figure 26:
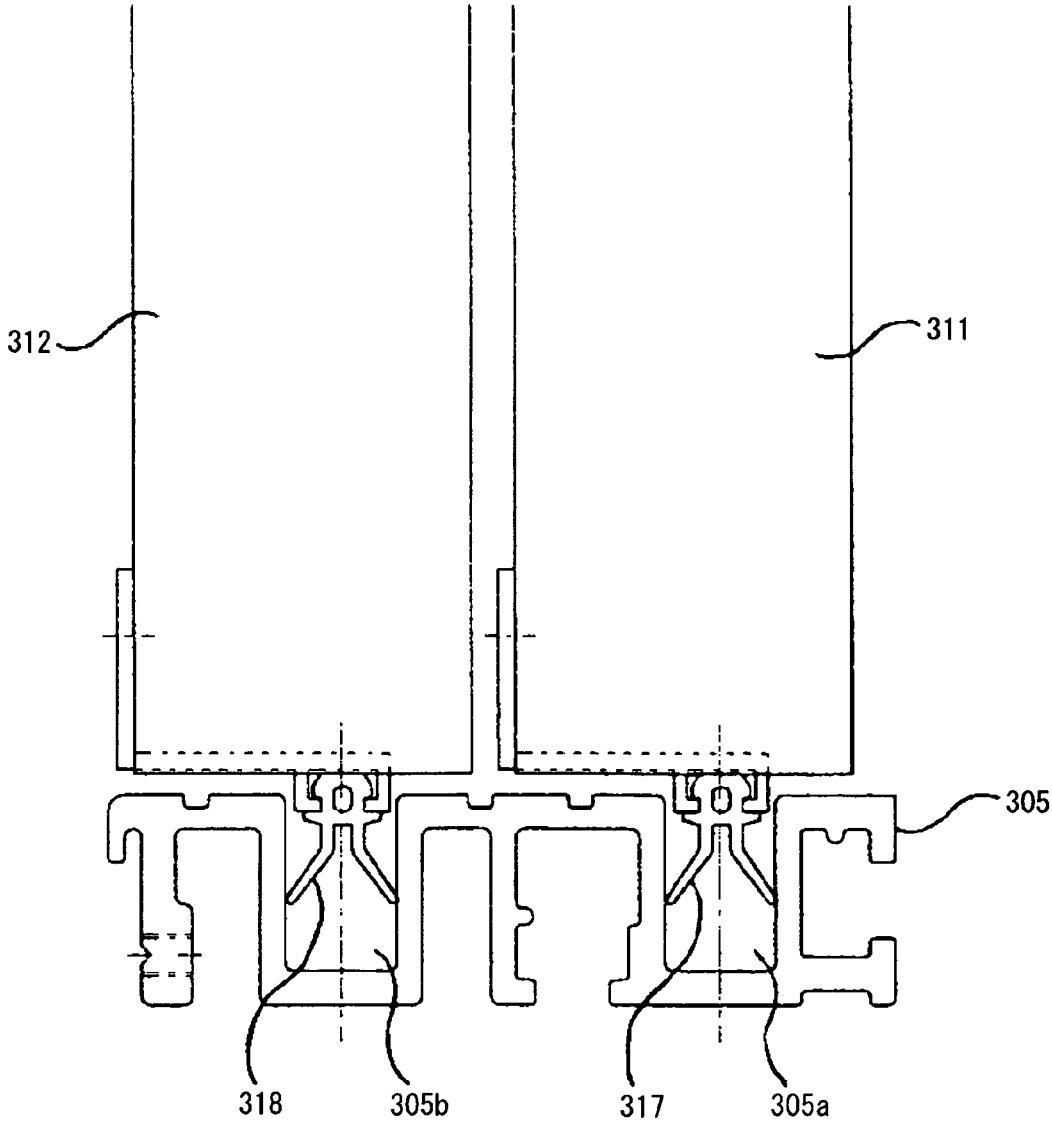
FIG. 26 is an enlarged view on arrow B-B shown in FIG. 24.
Figure 27:
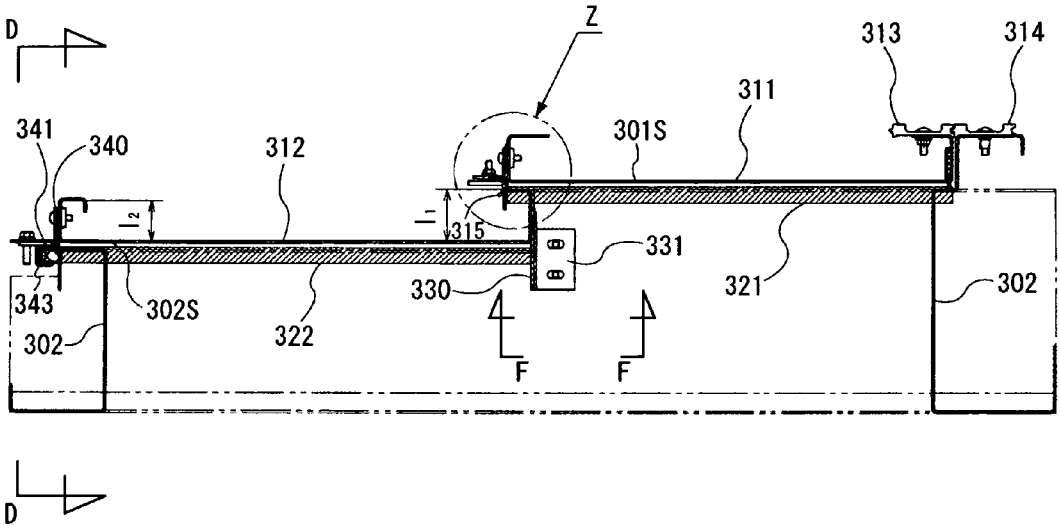
FIG. 27 is a view on arrow C-C shown in FIG. 24.
Figure 28:
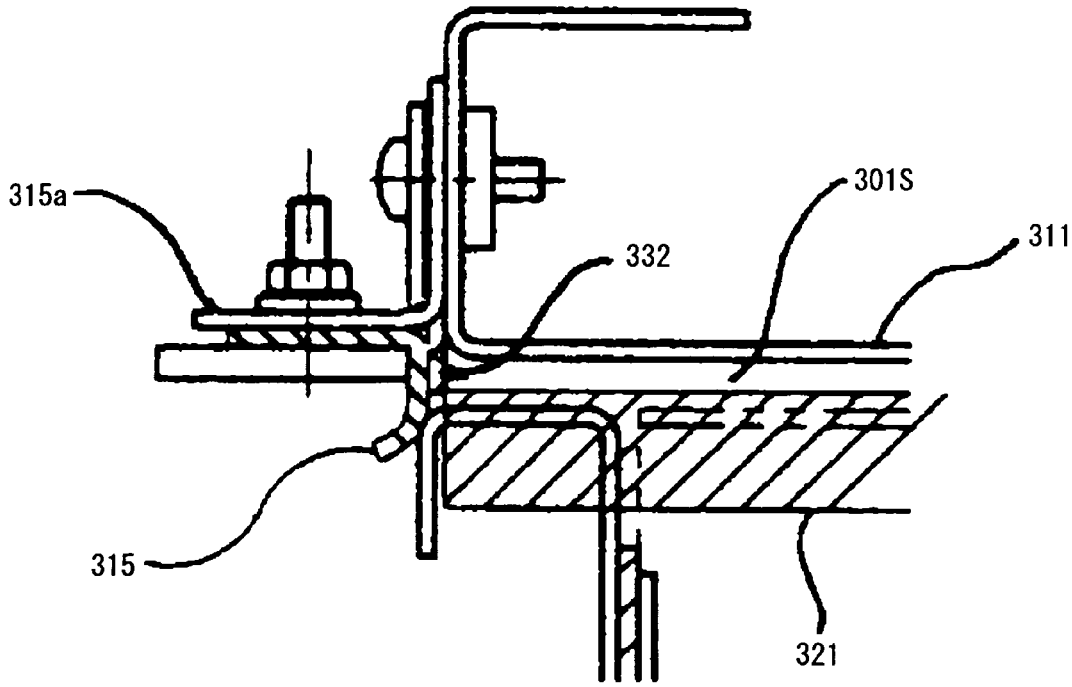
FIG. 28 is an enlarged view of a Z-portion shown in FIG. 27.
Figure 29:
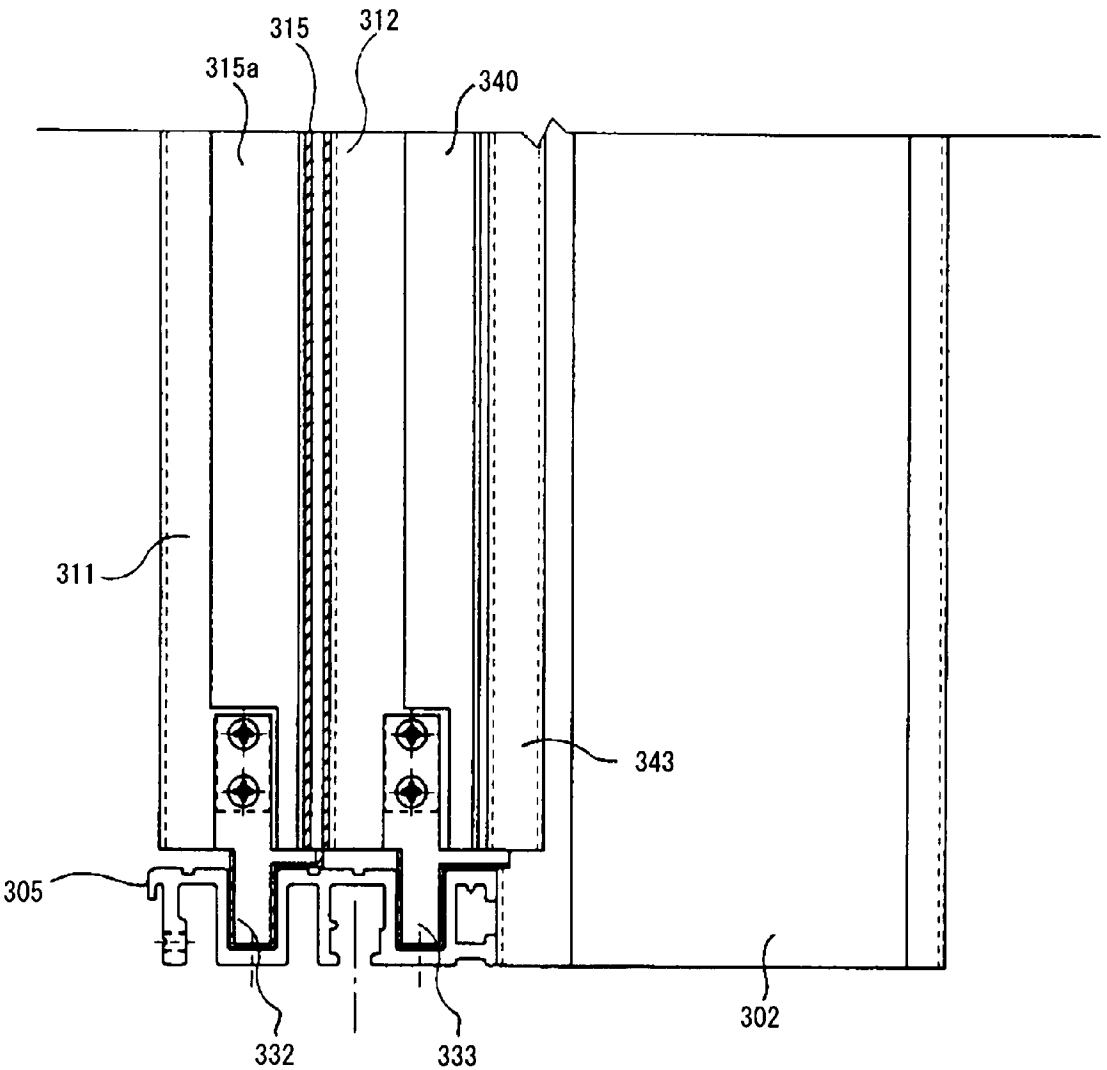
FIG. 29 is a view on arrow D-D shown in FIG. 27.
Figure 30:
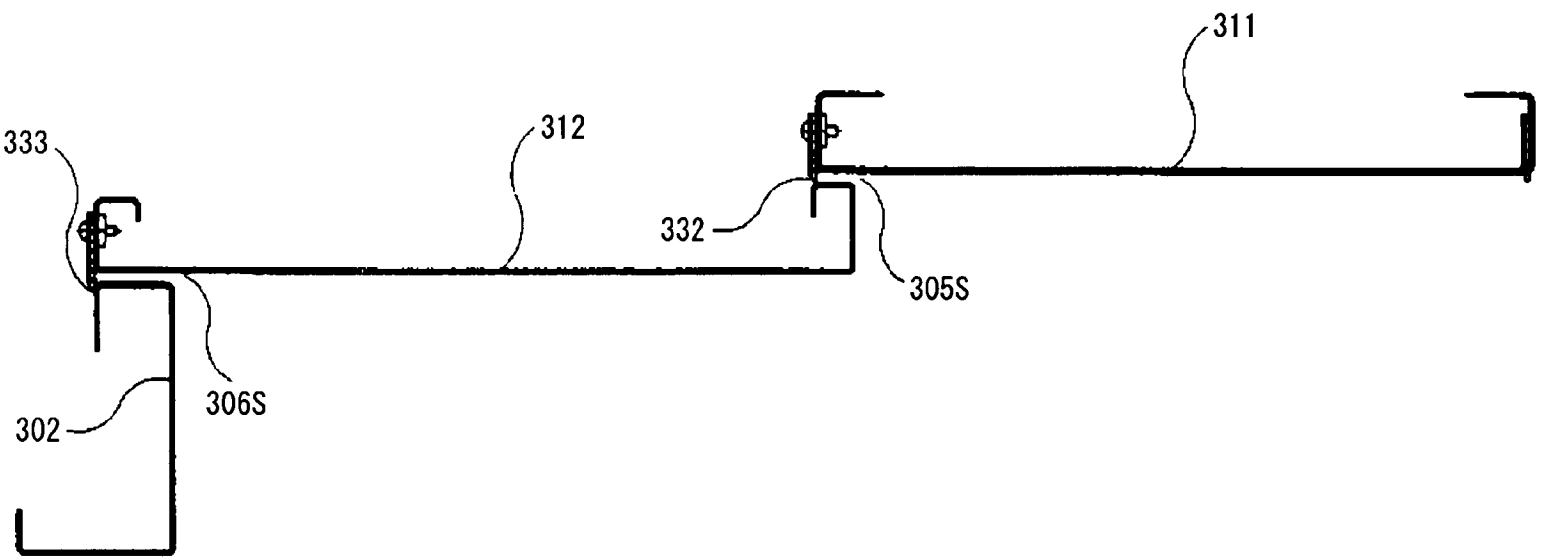
FIG. 30 is a view on arrow E-E shown in FIG. 24.
Figure 31:
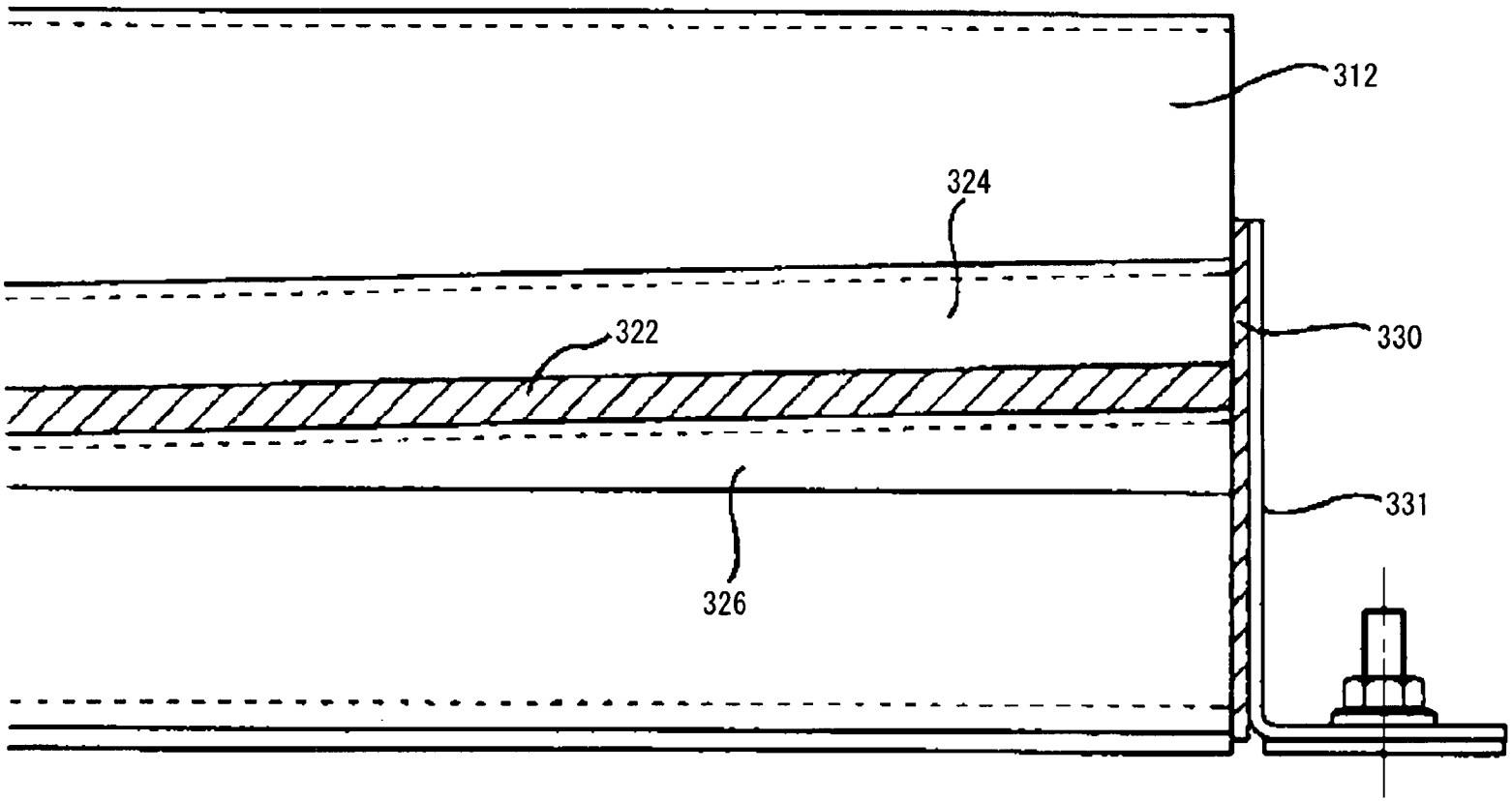
FIG. 31 is a fragmentary view on arrow F-F shown in FIG. 27.
Figure 32:
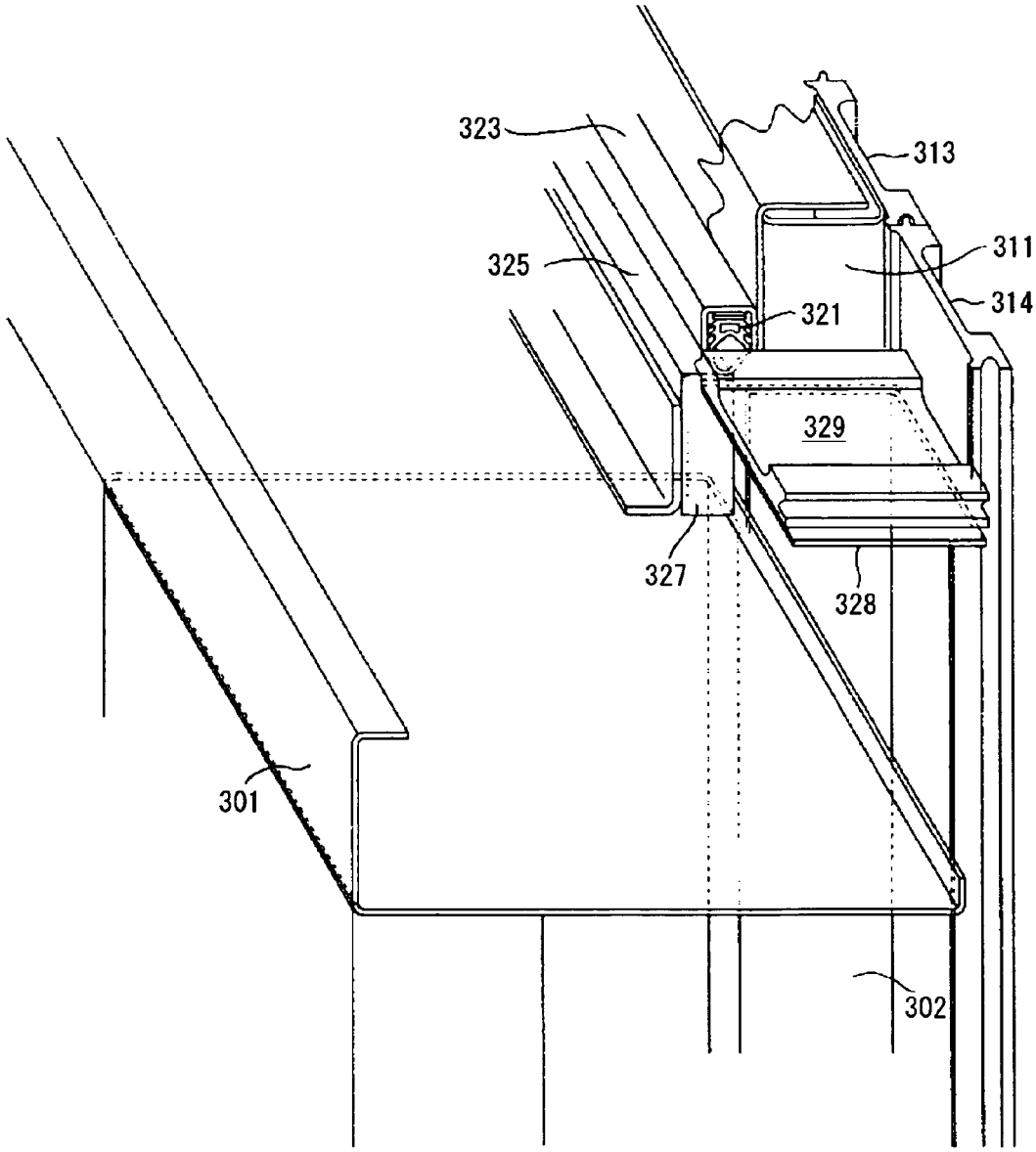
FIG. 32 is a perspective view showing the relationship among a high-speed door, an upper frame and a vertical frame.
Figure 33:
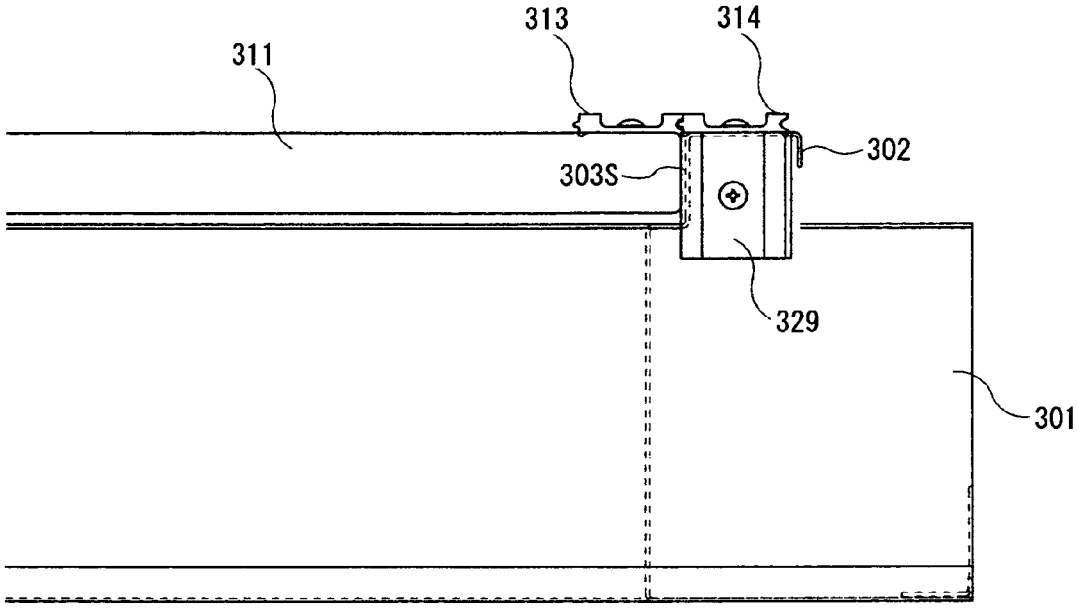
FIG. 33 is a plan view of FIG. 32.
Figure 34:
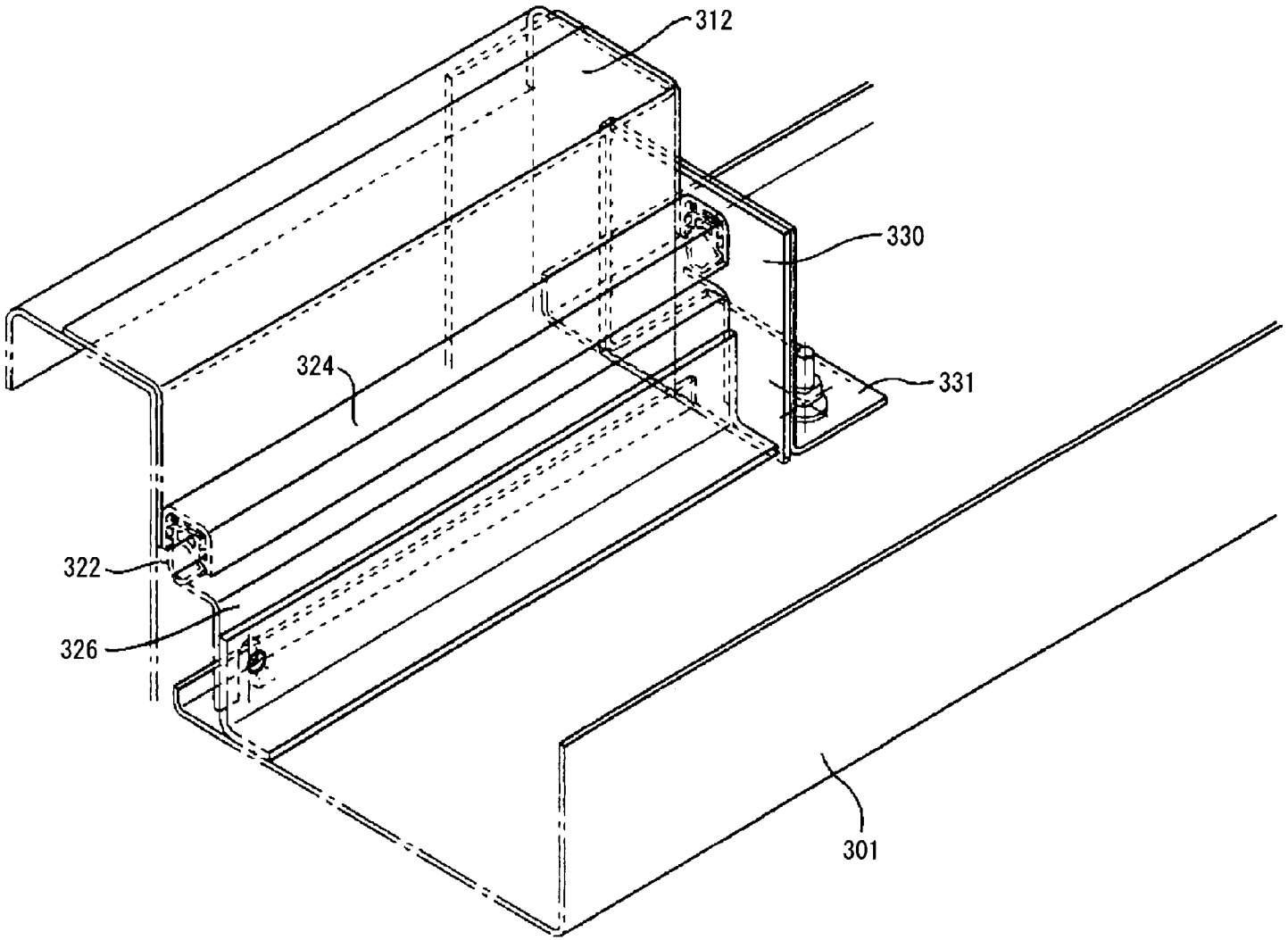
FIG. 34 is a perspective view showing the relationship between an upper portion of the low-speed door on the side of the high-speed door and the upper frame.
Figure 35:
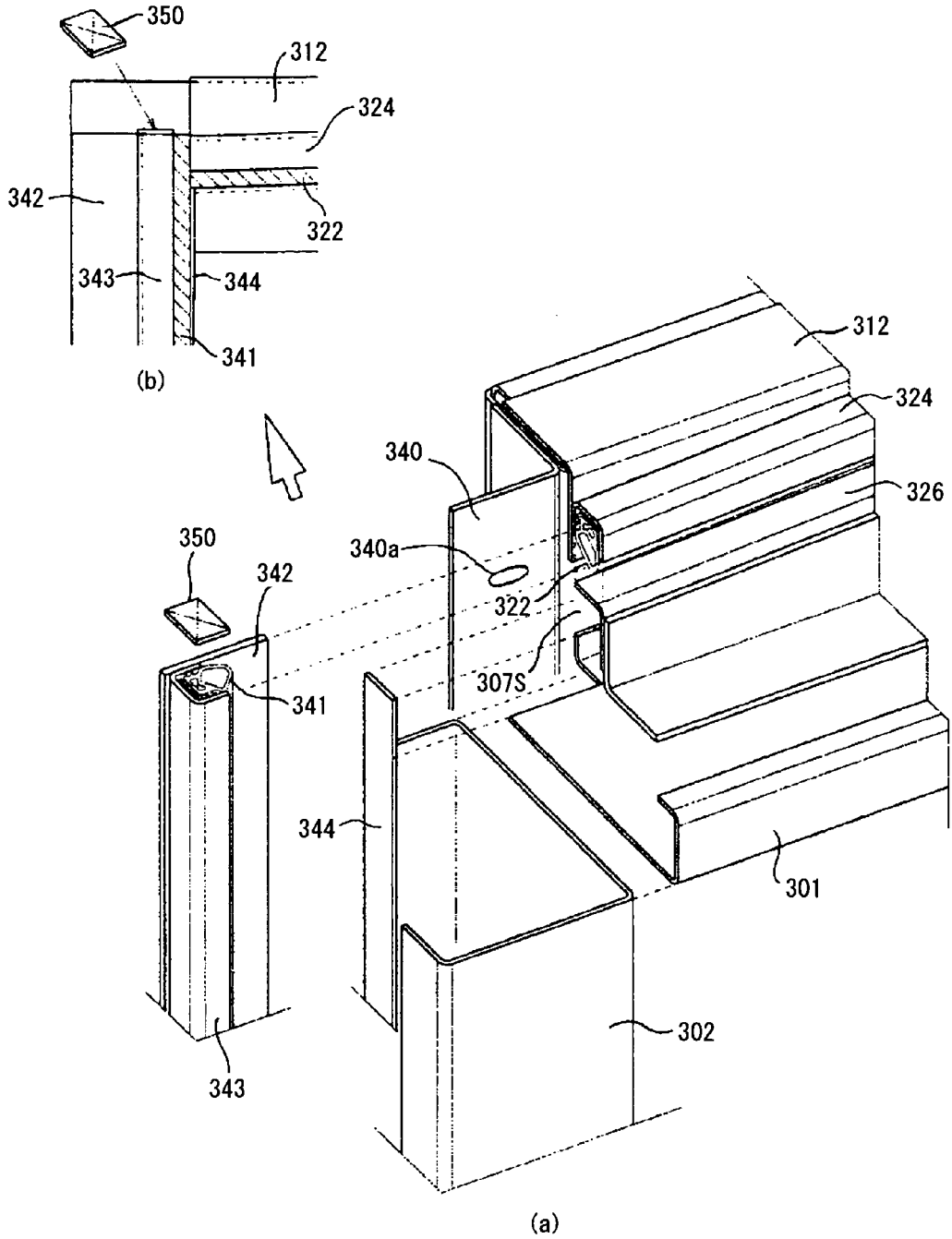
FIG. 35 is a perspective view and an enlarged fragmentary view showing the relationship among the low-speed door, the upper frame and the vertical frame.

FIG. 24 is a front view showing an example of an elevator-landing door embodying the present invention. FIG. 25 is an enlarged view on arrow A-A shown in FIG. 24. FIG. 26 is an enlarged view on arrow B-B shown in FIG. 24. FIG. 27 is a view on arrow C-C shown in FIG. 24. FIG. 28 is an enlarged view of Z-portion shown in FIG. 27. FIG. 29 is a view on arrow D-D shown in FIG. 27. FIG. 30 is a view on arrow E-E shown in FIG. 24. FIG. 31 is a fragmentary view on arrow F-F shown in FIG. 27. FIG. 32 is a perspective view showing the relationship among a high-speed door 311, an upper frame 301 and a vertical frame 302. FIG. 33 is a plan view of FIG. 32. FIG. 34 is a perspective view showing the relationship between an upper portion of the low-speed door 312 on the side of the high-speed door 311 and the upper frame 301. FIG. 35 is a perspective view and an enlarged fragmentary view showing the relationship among the low-speed door 312, the upper frame 301 and the vertical frame 302.

In FIG. 24, the numerals 311 and 312 indicate single open doors which are respectively hung on door hangers 307, 308. The door moving with high-speed is a high-speed door 311, and the door moving with low-speed is a low-speed door 312. Guide shoes 311*a*, 312*a* are respectively guided by grooves 305*a*, 305*b* of a sill 305 shown in FIG. 26. The landing doors 311, 312 are respectively given a door-closing force by a weight or a spring at all times, as not illustrated but well known. Incidentally the door 312 has an end portion adjacent to the opposite door 311 which is slightly bent owing to the reason to be described below.

In FIGS. 27 and 32, the numeral 313 indicates a rubber door stopper which is provided on the door 311 adjacent to an opposite door 312. The numeral 314 indicates a rubber door stopper which is provided on the vertical frame 302 as opposed to the rubber door stopper 313. One of the rubber door stoppers 313, 314 is formed with a recess while the other is formed with a projection so that the two rubber door stoppers are firmly in intimate contact with each other. The two rubber door stoppers are therefore brought into contact with each other with no space therebetween as serving as smoke shielding members. The arrangement wherein the two rubber door stoppers are in contact with no space is not limited to the present embodiment, but various arrangements can be given besides fitting of the recess and the projection.

In FIGS. 27 and 28, the numeral 315 indicates a smoke shielding member provided, with a bracket 315*a*, on an outer surface of the high-speed door 311 and adjacent to the low-speed door 312. The smoke shielding member 315 is in contact with the door 312 when the landing door is closed, to seal a gap 301*s*. The end portion of the door 312 adjacent to the opposite door 311 is bent slightly (one dimension: $l_1$, the other dimension: $l_2$, $l_1 > l_2$) so that the smoke shielding member 315 is not in contact with the door 312 when the landing door is opened. That is the door 312 has one side portion which is adjacent to the opposite door 311 and which is thinner than the other side portion. The numeral 341 to be described below indicates a smoke shielding member which is provided on an outer surface of the door 312 adjacent to the opposite door 311. The smoke shielding member 341 is in contact with the vertical frame 302 when the landing door is closed, to seal a gap 302*s*.

In FIG. 26, the numerals 317, 318 indicate smoke shielding members each comprising a pair of projections spreading toward an outer end, for example, and made of fire retardant rubber. The smoke shielding members 317, 318 are provided so as to be fitted into bottom recess portions of the doors 311, 312, and are mounted on portions besides the portions on which guide shoes 311*a*, 312*a* are mounted as shown in FIG. 24. The smoke shielding members 317, 318 can be bent so that outer ends of a pair of projections are not in contact with side walls of sill grooves 305*a*, 305*b* when the door is being opened or closed to thereby suppress the occurrence of wear of the outer ends of the smoke shielding members 317, 318 when normally opening-closing the door. In the event of a fire, air in space on fire is thermally expanded to force out high-pressure air containing smoke through a bottom portion of the door. When the air flows into the smoke shielding members 317, 318 provided on the bottom end of the door, one of the projections of the smoke shielding members adjacent to space not on fire is pressed against side walls of the sill grooves 305*a*, 305*b* to thereby reliably ensure the sufficient airtightness in accordance with a direction of smoke flow. The smoke shielding members 317, 318 can be formed so that the outer ends of a pair of projections are bent slightly inwardly.

In FIG. 25, the numerals 321, 322 indicate, for example, hollow smoke shielding members which are slopingly mounted on an upper portion of the doors 311, 312 and which are removably inserted into U-groove brackets 323, 324 shown in FIG. 24. The smoke shielding members 321, 322 are so arranged slopingly as to be positioned at a higher level as being close to a door closed position. The U-groove bracket 323 and the smoke shielding member 321 are arranged in a cutout 312*b* of the door 312. The numerals 325, 326 indicate stop boards which are adjustable in a direction perpendicular to the upper frame 301. The stop boards are brought into contact with the smoke shielding members 321, 322 when the doors 311, 312 are closed to close gaps 303*s*, 304*s*. The stop boards 325, 326 are also so arranged slopingly as shown in FIG. 24.

In FIG. 32, the numeral 327 indicates a flat board for covering an end portion of the board 325, and 328 is a base provided so as to be in contact with the flat board 327. A rubber door stopper 329 is mounted on the base 328. When the door 311 is being closed, the rubber door stoppers 313, 314 come into intimate contact with each other while there exists a gap 303*s* between the door 311 and the vertical frame 302 in an upward direction as shown in FIG. 33. The rubber door stopper 329 covers the gap 303*s* to thereby close properly the gap 303*s*. Used as the rubber door stopper 329 is the same member as the aforementioned rubber door stoppers 313, 314 according to the example, but the rubber door stopper 329 can be formed into a flat board.

In FIGS. 27, 31 and 34, the numeral 330 indicates a flat board for covering end portions of the smoke shielding member 322, the stop board 326, and the U-groove bracket 324 when the door 312 is closed, and which is mounted on the upper frame 301 with an L-shaped bracket 331. In FIGS. 27, 28, 29 and 30, the numeral 332 indicates a flat board having an elastic body and which is arranged in a cutout portion of the bracket 315*a* on an outer surface of a bottom end side of the door 311. The flat board 332 has a function for closing a gap 305*s* of a lower portion of the smoke shielding member 315 when the door 311 is closed. A flat board 333 having the same elastic body in shape and structure as that of the flat board 332 is, as in the same manner, arranged in a cutout portion of the bracket 340 (to be described below) on an outer surface of a bottom end side of the door 312. The flat board 333 closes a gap 306*s* of a lower portion of the smoke shielding member 341 to be described below when the door 312 is closed. The shape and structure of the flat boards 332, 333 can be altered in accordance with occasions. Furthermore the flat boards 332, 333 are not limitedly mounted in the position as described in the embodiment.

In FIG. 35, the numeral 340 indicates an L-shaped bracket provided on an outer surface of a side portion of the door 312. A smoke shielding member 341 is removably inserted into a U-shaped groove bracket 343 provided on a bracket 342. The bracket 342 having the smoke shielding member 341 is attached to the bracket 340 as adjustable widthwise of the door 312 through a long hole 340*a*. Therefore the smoke shielding member 322 is always in contact with the smoke shielding member 341. The smoke shielding member 322 and the smoke shielding member 341 are most preferably arranged on the same vertical plane.

The numeral 344 indicates a bracket provided on the vertical frame 302 such that the bracket extends upwardly. The upper frame 301 is placed on the vertical frame 302 such that the upper frame 301 covers the vertical frame 302, so that the bracket 344 is so arranged as to cover a part of the side portion of the upper frame 301. The numeral 350 indicates a cover for covering an upper portion of the smoke shielding member 341. When the door 312 is being closed, the smoke shielding member 341 is pressed into contact with one surface of the bracket 344, whereby the provision of the smoke shielding member 322 and the smoke shielding member 341 closes a gap 307*s* among the door 312, the vertical frame 302 and the upper frame 301.

Figure 36:
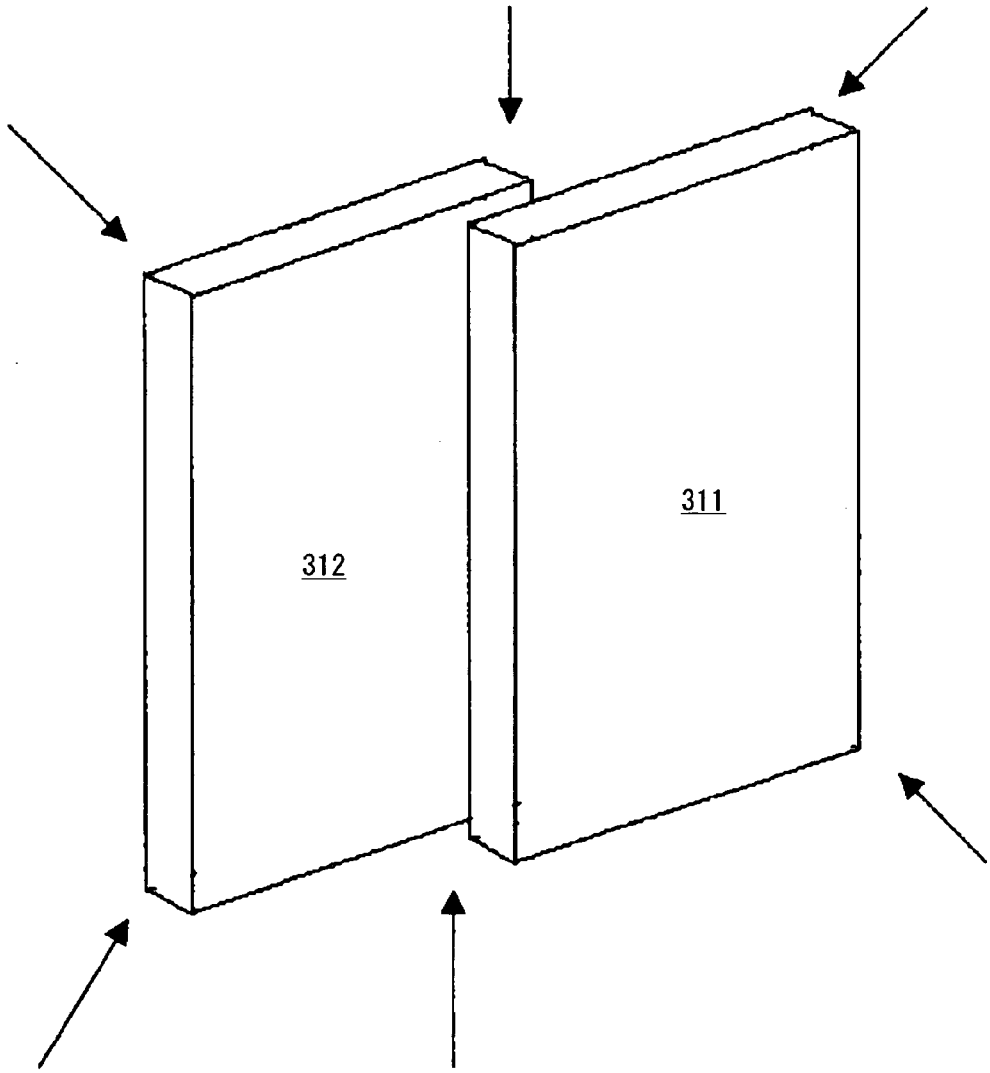
FIG. 36 is a diagram illustrating the effect of the present embodiment.

Accordingly, when the landing doors 311, 312 are closed, a gap between the vertical frame 302 and the door 311 is closed by the rubber door stopper 313, the rubber door stopper 314 and the rubber door stopper 329, a gap between the door 312 and the vertical frame 302 is closed by the bracket 344 and the smoke shielding member 341, a gap between the door 311 and the door 312 is closed by the flat board 332 and the smoke shielding member 315, a gap between the upper frame 301 and the door 311 is closed by the smoke shielding member 321, the stop board 325 and the rubber door stopper 329, a gap between the door 312 and the upper frame 301 is closed by the flat board 330, the smoke shielding member 322 and the stop board 326, a gap between the door 311 or the door 312 and the sill 305 is closed by the smoke shielding members 317, 318 and the flat board 332, 333, to thereby reliably prevent the passage of smoke through the landing hall into the hoistway and the passage of smoke through the hoistway into the landing hall. Particularly the passage of smoke can reliably be blocked through gaps indicated by arrows in FIG. 36 wherein three or more components are opposed to each other, whereby the smoke shielding effect is fully established.

The materials and shapes of the smoke shielding members 317, 318, the smoke shielding members 321, 322, and the smoke shielding members 315, 341 should be determined in accordance with the respective roles, functions and characteristics. As to the smoke shielding members 315, 341, a surface of the members 315, 341 is merely pressed, so that only the smoke shielding performance should be fulfilled while the consideration of the movement with friction is not particularly required. On the other hand, as to the smoke shielding members 317, 318, relative motion between the members 317, 318 and the sill 305 always occurs with door opening-closing operation, so that there is a need to consider not only the smoke shielding performance but friction (including the problem of vibration and noise), and function for performing a smooth sliding operation is required. Furthermore, the smoke shielding members 321, 322 are subject to friction due to relative motion between the stop boards 325, 326 and the members 321, 322 just before the door is fully closed, so that the smoke shielding members 321, 322 need to have a function for performing a smooth sliding operation, although its smoothness is not as good as that of the smoke shielding members 317, 318. Therefore, it is desirable to have both the smoke shielding performance and sliding performance. The doors 311, 312 are closed as pressed against by the door stopping boards 325, 326 at ends of closed doors. This state occurs with friction, so that the smoke shielding members 321, 322 are to be subject to a special work for improving wear resistance with low coefficient of friction. It is effective to apply to the side of the stop boards 325, 326, a tape, etc. having an excellent sliding performance.

In the event of a fire, temperature and pressure are particularly variable. Therefore it is effective that the members to be deformed due to the variations of temperature and pressure, e.g., the smoke shielding members 321, 322, 341 are such that a hollow portion is slightly expanded, or said members, e.g., the smoke shielding members 317, 318 are such that a pair of projections are deformed in accordance with a direction of smoke flow. Furthermore in addition to the case wherein the shape of the smoke shielding member is altered in accordance with pressure difference, the same effect can be obtained by the arrangement wherein the member (U-groove bracket, etc.) for supporting the smoke shielding member is movable. Furthermore the specification on the smoke shielding performance provides that the smoke leakage be not greater than 0.2 $m^3/min \times m^2$ when pressure difference between opposite sides of the doors is 19.6 Pa, so that the smoke shielding performance is not completely required, and therefore the members are not necessarily in complete intimate contact with each other.

Figure 37:
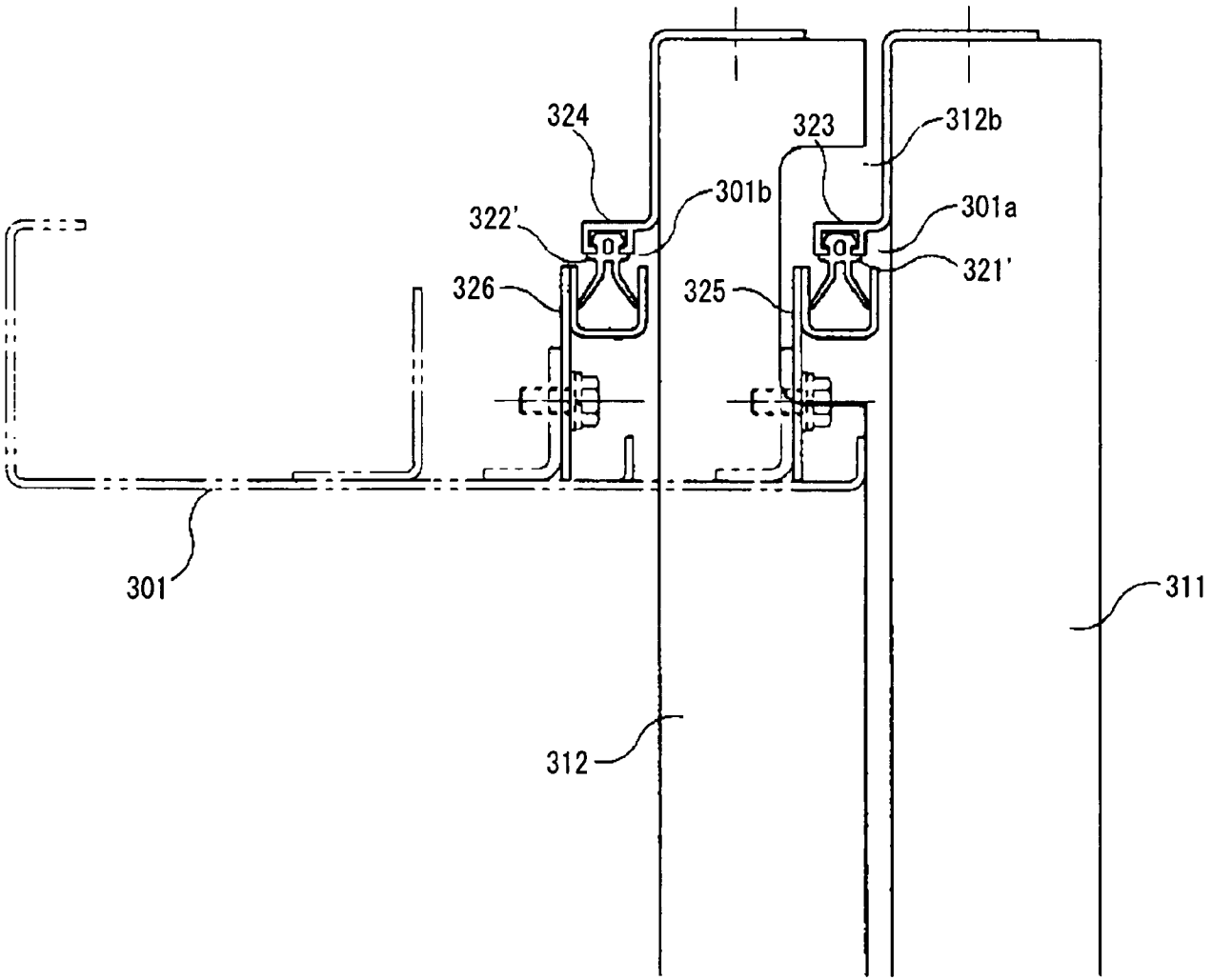
FIG. 37 is a diagram showing another construction example of the present embodiment.

FIG. 37 shows the case wherein the members for use as the smoke shielding members 321', 322' are the same members as those for use as the smoke shielding members 317, 318. Thus sharing parts as much as possible reduces the number of parts, hence convenient. However, in accordance with characteristics, roles, functions which the members are required to be provided with, materials and shapes can be suitably selected and determined.

Further, with the second embodiment described, there is very few likelihood of interferences such as vibration or noise with usual opening-closing operation of the door. The door closed state reliably blocks the gap between the landing door and the entrance frame, between the landing door and the sill, or between the doors, in accordance with the occasions, so that even if a fire breaks out at any time, the infiltration of smoke can be properly blocked. Furthermore there is no need to provide a special drive system or device for the function of smoke shielding and smoke prevention. The device of the present embodiment has an advantage of being additionally employed in existing elevators.

Third Embodiment

Figure 38:
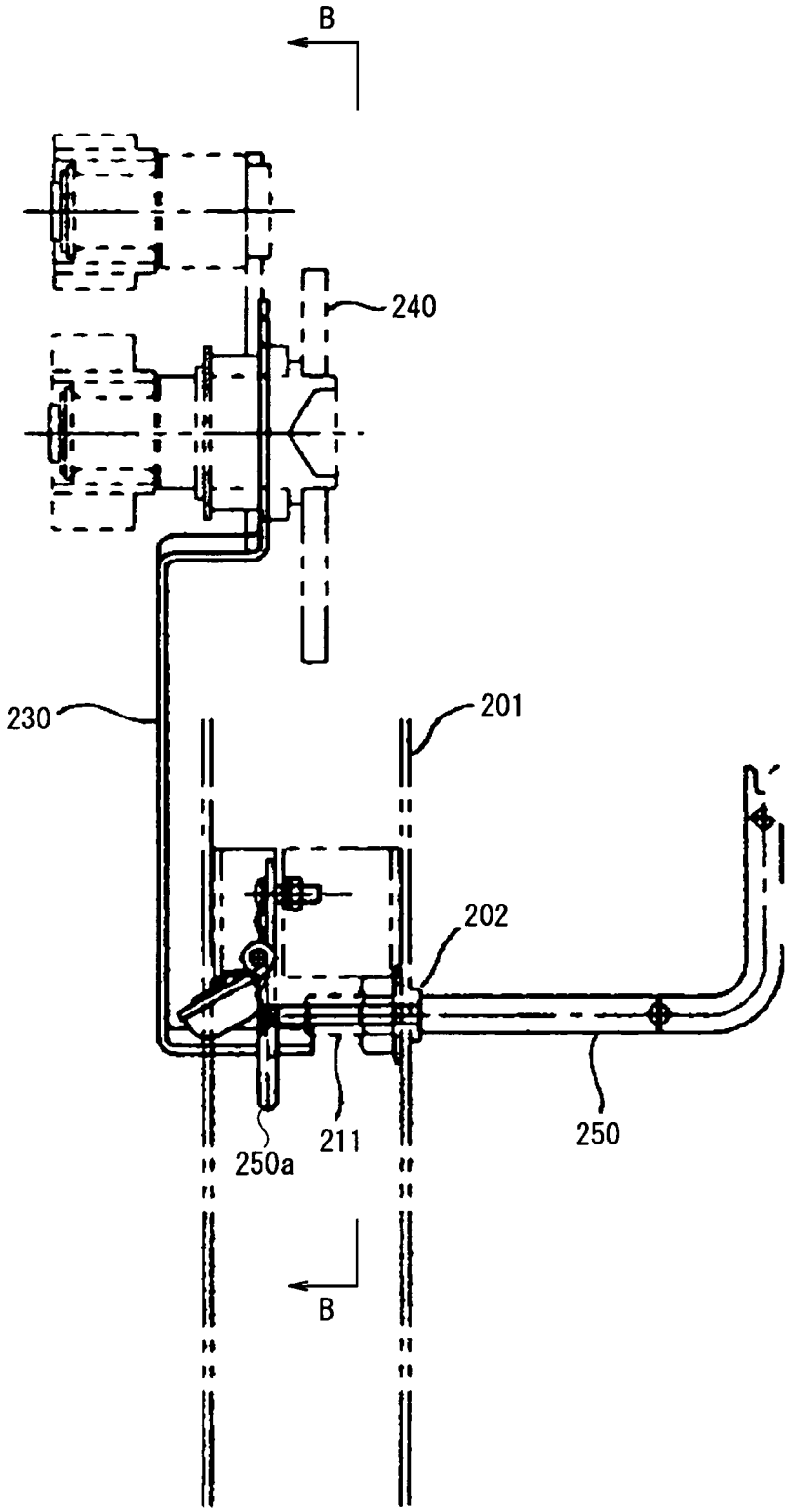
FIG. 38 is an overall view of a lock assembly of the door unit in a third embodiment of the present invention.
Figure 39:
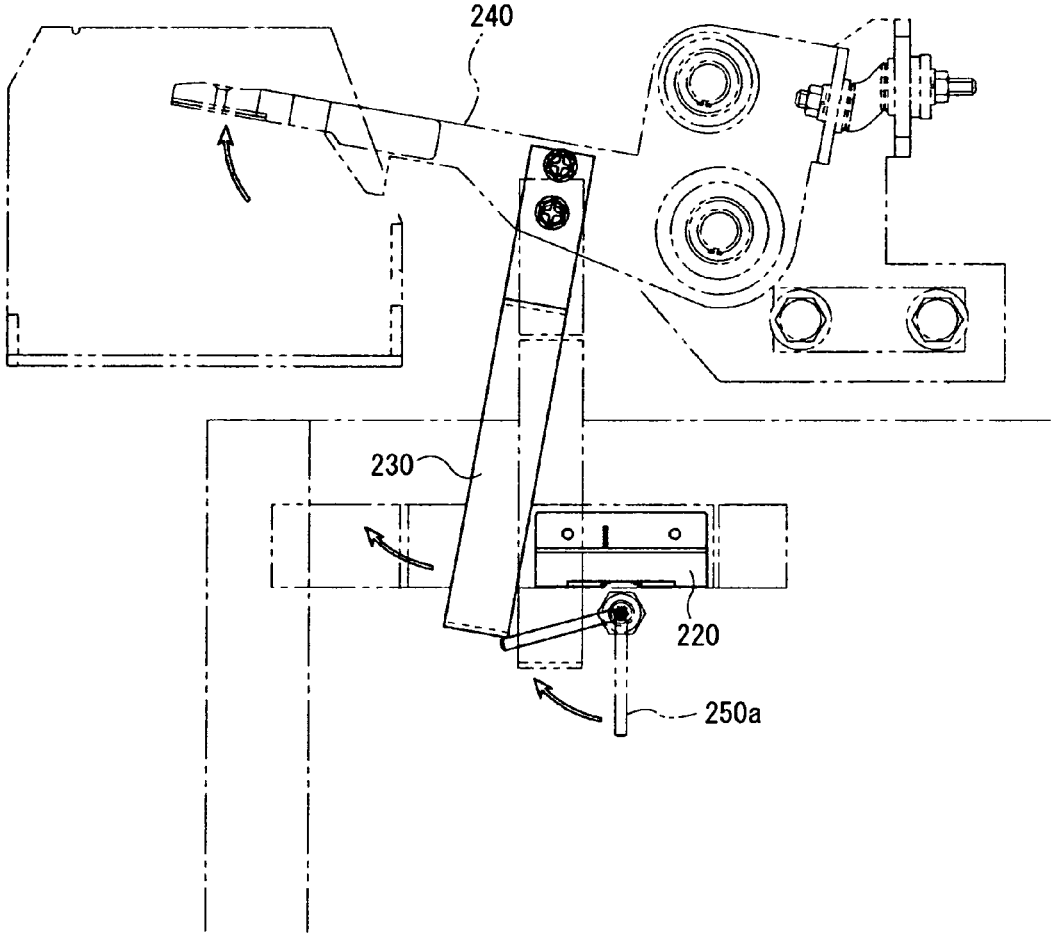
FIG. 39 is a view on arrow B-B shown in FIG. 38.
Figure 40:
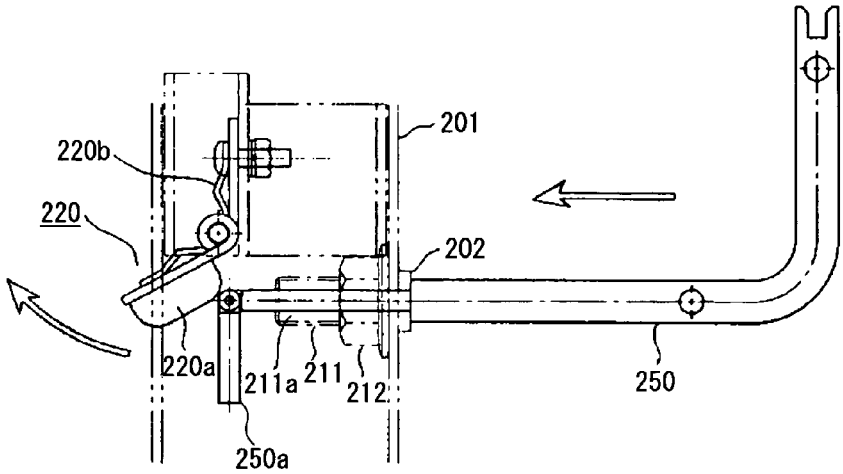
FIG. 40 is a diagram for illustrating the operation of the lock assembly.
Figure 40:
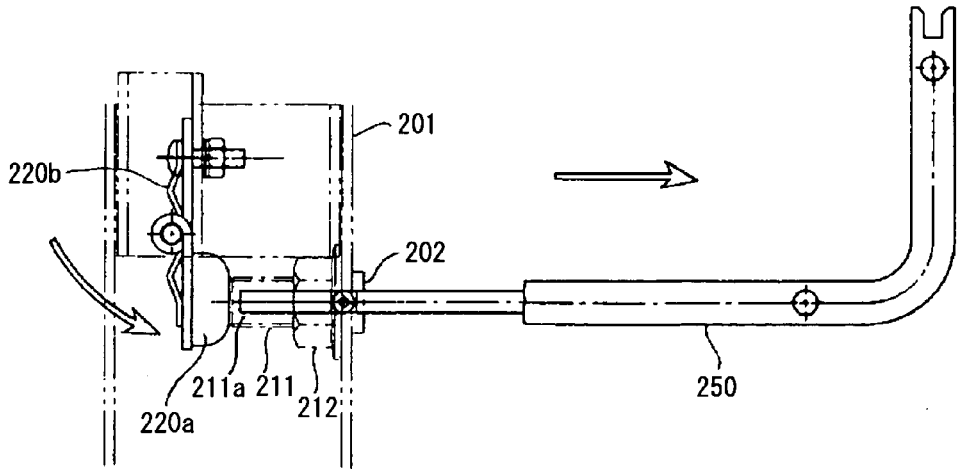

FIG. 38 is an overall view showing an example of a lock assembly embodying the present invention. FIG. 39 is a view on arrow B-B shown in FIG. 38. FIG. 40 is a diagram for illustrating the operation of the present invention unit.

The numeral 201 in the drawings indicates a landing door having a hollow member 211 arranged therein with a nut 212. The numeral 220 indicates a valve which is supported by, for example, a hinge mechanism and which is provided in the landing door 201 so as to be opposed to a key hole 202 and which has a packing 220*a* closing an opening 211*a* of the hollow member 211 to thereby fulfill smoke shielding performance. The opening 211*a* is normally held closed by a torsion 220*b*. The hollow member provides a specified distance from a surface of the landing door 210 to thereby prevent the control with a merely piece of wire and discourage tampering.

The numeral 230 indicates a lever for manipulating a lock fitting 240. The lever 230 has an end connected to the lock fitting 240 and has the other end arranged, for example, around a lower portion of the hollow member 211. On the other hand, the numeral 250 indicates an unlock key embodying the present invention. The unlock key 250 is in the form of an L-shape, for example, and has an outer end bendable in a specified direction. According to the embodiment illustrated, an outer end of the unlock key is bendable in the opposite direction to the L-shape.

Next, an unlocking operation of this assembly will be described with reference to the drawings. First, an outer end of the unlock key 250 is inserted into a key hole 202 with one side part of the key 250 directed upward. Then the key 250 thrust deeply, to allow its outer end to extend through the hollow member 211, pressing rearward the packing 220*a*. This packing 220*a* turns backward against spring force of the torsion spring 220*b* as shown in FIG. 40(*b*) simultaneously when an end portion of the unlock key 250 is bent downward by its own weight and is then hung downward.

Subsequently, with reference to FIGS. 38 and 40(*b*), the side part of the unlock key 250 in an upward direction is turned forward, bringing an end portion 250*a* into contact with the lever 230, to press the lever 230 rearward shown in FIG. 38, i.e., rotating the lever 230 in the direction of an arrow as shown in FIG. 39, to rotate upward the lock fitting 240, thereby unlocking the lock. Therefore opening the key hole 202 and unlocking the lock are organically linked. This makes it possible to open-close the landing doors so smoothly, whereby rescue and maintenance works can be performed readily. Incidentally, the provision of the hollow member 211 and the arrangement relationship between the lever 230 and the hollow member 211 prevent the control with merely a piece of wire, to obviate tampering for opening the landing doors 210, but the other arrangement is also available wherein the key hole 2 of the landing door is merely covered with the valve 220.

In this case, the outer end portion of the unlock key 250 is bent by its own weight. Alternately the outer end portion can also be bent in the opposite direction to the opening direction of the valve 210. On the other hand, the other end of the lever 230 can be arranged not only around the lower portion, but around the opening side of the valve 210.

According to the third embodiment, the opening-closing valve can reliably prevent the infiltration of smoke, keeping the smoke shielding performance extremely excellent. Furthermore unlocking the landing door can be performed so readily without any problem.

Fourth Embodiment

Figure 47:
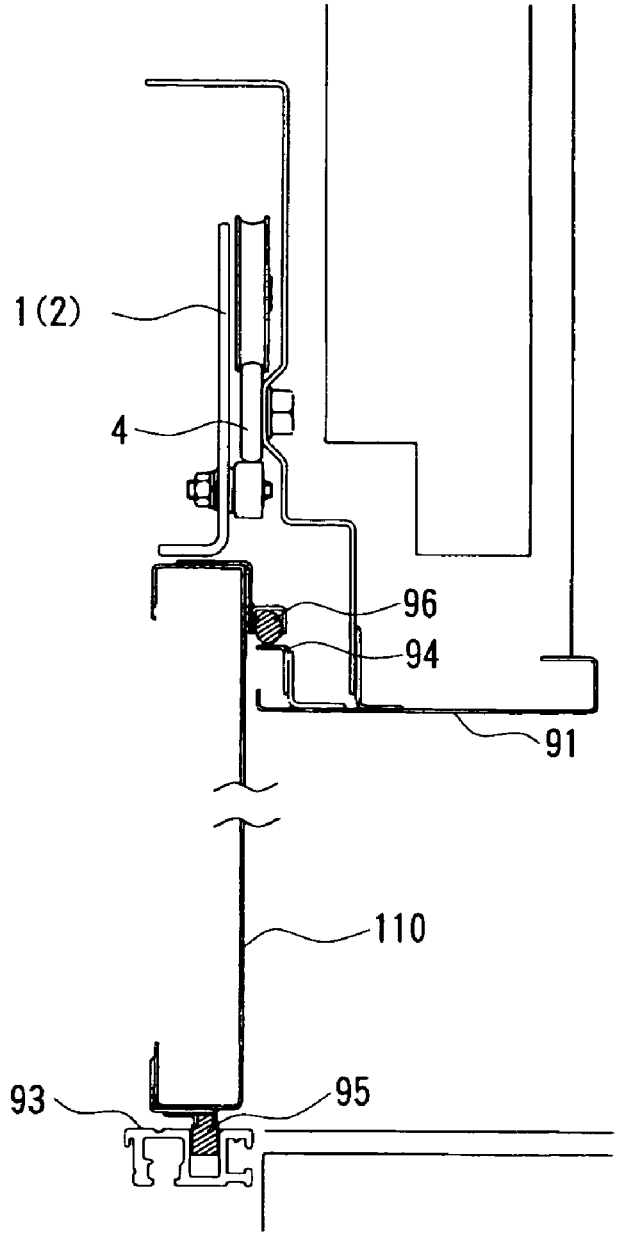
FIG. 47 is a sectional view showing a smoke shielding mechanism.
Figure 48:
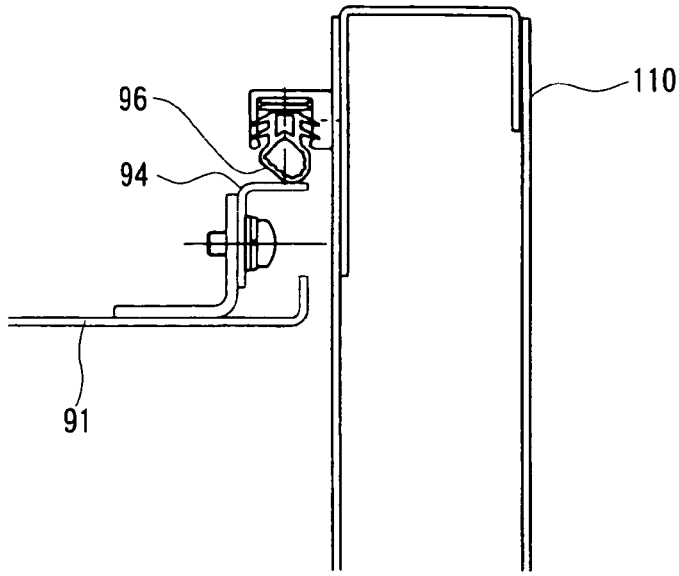
FIG. 48 is a sectional view showing a structure of the upper smoke shielding mechanism.
Figure 50:
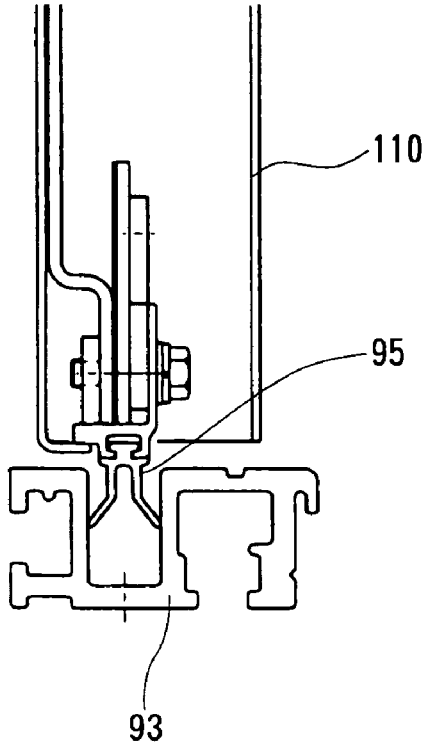
FIG. 50 is a sectional view showing a structure of the lower smoke shielding mechanism.

A door unit of the present embodiment has smoke shielding members 95, 96, which are respectively mounted on a bottom end portion of a door 110 and on a top portion of a rear surface of the door 110 as shown in FIG. 47. The upper smoke shielding member 96 comes into sliding contact with a stop board 94 projecting from an upper frame 91 thereof, as shown in FIG. 48, while the door 9 is moved from a position in the vicinity of a fully closed position to a fully closed position, to block the smoke in the event of a fire. Further the lower smoke shielding member 95 is slidably fitted into a groove of a sill 93 as shown in FIG. 50, blocking the smoke in the event of a fire.

Figure 49:
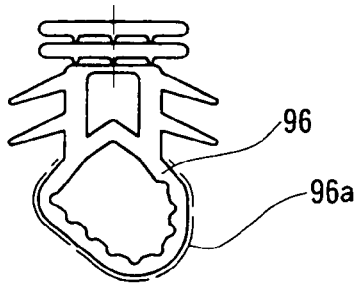
FIG. 49 is a sectional view showing a smoke-shielding member provided on an upper portion.

The upper smoke shielding member 96 is made from synthetic resin and has a portion in sliding contact with the stop board 94 and which is in the form of a ring in section as shown in FIG. 49. The smoke shielding member 96 has a surface subject to coating 96*a* by surface-activity-modifying treatment, e.g., silicon polymer, etc., thereby suppressing wear of the smoke shielding member 96 due to friction with the stop board 94, and noise occurrence.

Figure 51:
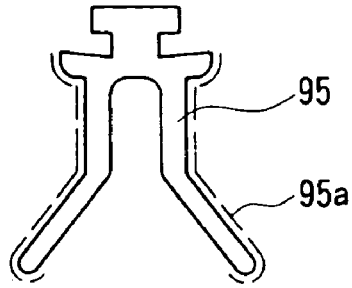
FIG. 51 is a sectional view showing a smoke-shielding member provided on a lower portion.

The bottom smoke shielding member 95 is made from synthetic resin and is formed in section such that a portion in sliding contact with the sill 93 spreads downward as shown in FIG. 51. The smoke shielding member 95 has a surface subject to coating 95*a* by surface-activity-improving treatment, e.g., urethane polymer, etc., thereby suppressing wear of the smoke shielding member 95 due to friction with the sill 93 and noise occurrence. Various methods of surface-treatment of the smoke shielding members 96, 95 can be adopted besides this method as long as the methods are excellent in slipperiness and wear-resistance. Furthermore, whereas the smoke shielding members 96, 95 are each surface-treated, only one of the members can be surface-treated.

Figure 41:
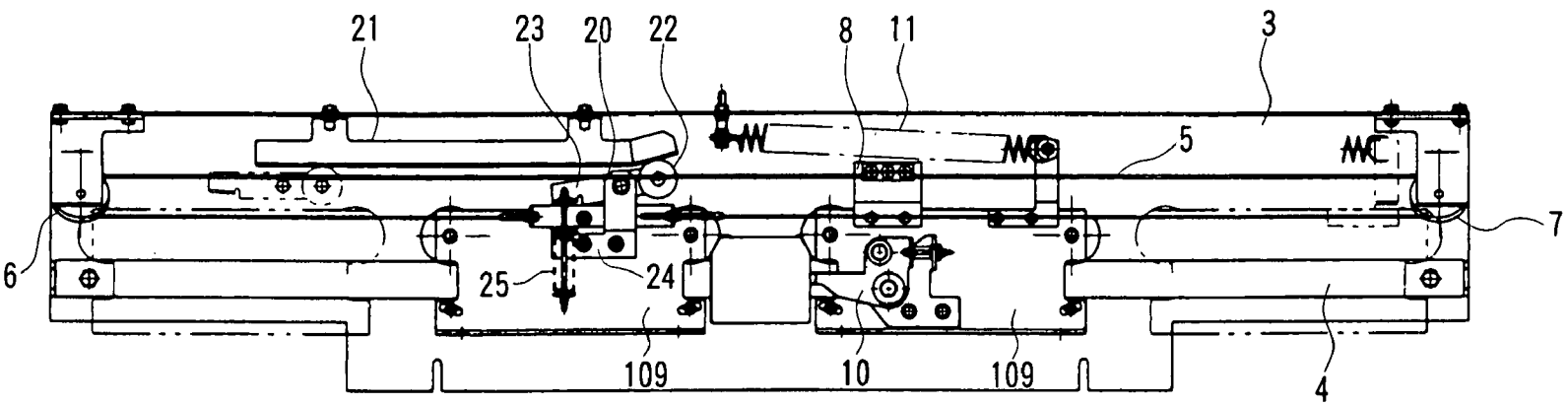
FIG. 41 is a fragmentary front view showing the door unit of the present invention.

A header 3 is mounted on an upper position of an opening leading from a landing hall to a hoistway as seen in FIG. 41.

The header 3 is provided with a rail 4 horizontally. The rail 4 is movably provided with a pair of hangers 109, 109 along the rail 4. The header 3 has a pair of pulleys 6, 7 arranged on opposite ends thereof. Wire 5 is wound around the pulleys 6, 7. Opposite ends of wire are connected to one of hangers 109. A grip 8 is secured to an intermediate position of wire 5 extending between the pulleys 6, 7. The grip 8 is connected to the other hanger 109. This causes the two hangers 109, 109 to move in opposite directions to each other.

Figure 42:
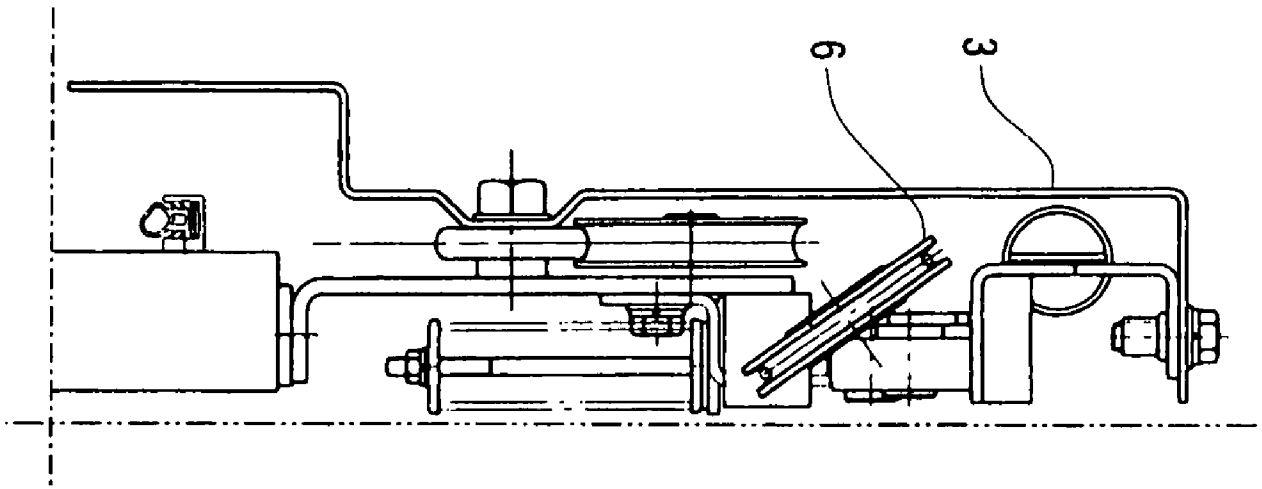
FIG. 42 is a left side elevation of FIG. 40.

The two pulleys 6, 7 are supported in an inclined posture as shown in FIG. 42, whereby space is effectively used.

With reference to FIG. 41, the other hanger 109 aforementioned is provided with a lock assembly 10 for locking the door at a fully closed position. A spring 11 extends between the hanger 109 and the header 3. The pair of hangers 109, 109 are always biased by the spring 11 in a door-closing direction.

Furthermore, the other hanger 109 is coupled to a door-closing enforcement device 20 embodying the present invention. With the door-closing enforcement device 20, a cam 21 is secured to the header 3. An intermediate portion of the lever 23 is pivotally supported by a bracket 24 on the hanger 109. A spring 25 is connected to a base end of the lever 23. The lever 23 is always biased counterclockwise by the spring 25. A roller 22 is rotatably supported on an outer end of the lever 23. The biasing force of the spring 25 presses the roller 22 into contact with the cam 21.

As described above, while one of the pair of hangers 109, 109 is provided with the device 20 for increasing door-closing force, the other hanger 109 is provided with the lock assembly 10. Therefore, even though the wire 5 is cut due to the occurrence of fire, etc., the door supported by the one hanger 109 is held at a closed position owing to the operation of the device 20 for increasing door-closing force, and the door supported by the other hanger 109 cannot be manually opened owing to the operation of the lock assembly 10. Thus the doors are held closed, hence safe.

The door-closing enforcement device 20 can be provided with an adjusting mechanism for adjusting the magnitude of door-closing force increasing and a position of the door at which the door-closing force starts to increase. For example, usable as the adjusting mechanism is one for shifting vertically or horizontally a position of a roller supporting mechanism comprising the roller 22 and the lever 23 and another one for adjusting the amount of initial deformation of the spring 25. This makes it possible to adjust readily the door-closing force on the site.

With reference to FIG. 41, indicated by chain double-dashed lines are the positions of the hangers 109, 109 and the roller 22 in the door fully-opened state, while indicated by solid lines are the positions of the hangers 109, 109 and the roller 22 in the door fully-closed state. During the transition from the door fully-opened state to the door fully-closed state, the roller 22 is first guided by a horizontal plane of the cam 21. At this time the spring 25 exerts on the roller 22 a reaction force perpendicular to the horizontal cam while a horizontal component does not occur, so that the door is biased by the spring 11 as in the case with the conventional device to drive the door into the closing direction. Thereafter, right before the transition progresses to the door fully-closed state, the roller 22 is pressed into contact with an inclined cam surface of the cam 21 to exert on the roller 22 a reaction force perpendicular to the inclined cam surface. The reaction force has a horizontal component, which biases the hanger 109 into the closing direction. Consequently, the door-closing force by the bias of the spring 11 and the door-closing force by the horizontal component are simultaneously applied to the door to increase the door-closing force.

With the door unit described, while the door is moved from the position in the vicinity of the fully closed position to the fully closed position, the upper smoke shielding member 96 starts to be into sliding contact with the stop board 94 particularly right before the door fully-closed state, to exert a resistance force on the movement of the door. However, the door-closing enforcement device 20 increases the door-closing force such that the magnitude of the door-closing force exceeds the resistance force, whereby the door is completely closed.

Furthermore, even though the great resistance force is exerted right before the door fully-closed state in the case where an outdoor elevator is greatly influenced by wind in opening-closing door or in other various cases, increasing the door-closing force by the door-closing enforcement device 20 closes the door completely.

Figure 43:
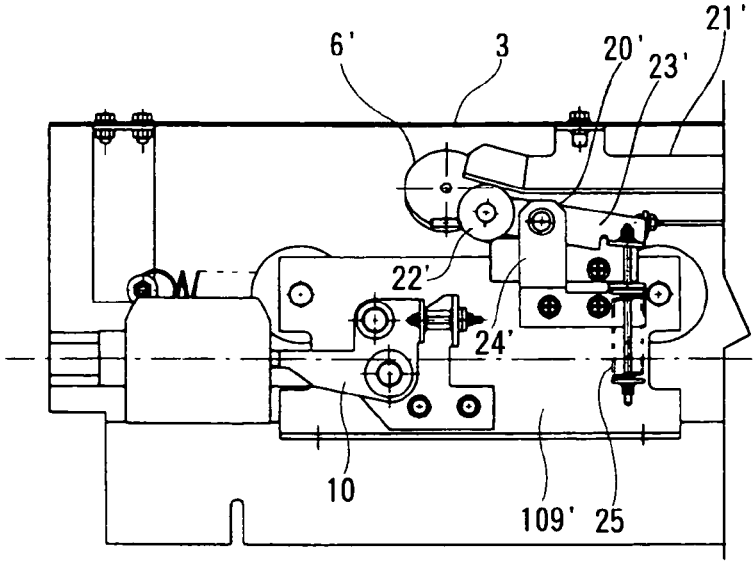
FIG. 43 is a front view showing another example of the door unit.
Figure 44:
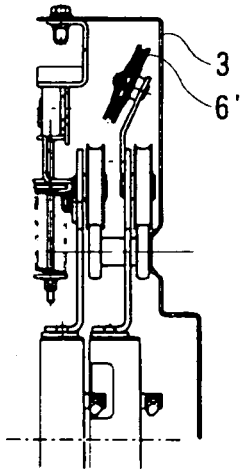
FIG. 44 is a right side elevation of FIG. 43.

FIGS. 43 and 44 show a door unit with a single open structure and which comprises two doors to be opened from one side into a single direction. Because the structure offers a relatively enough space, a part of a door-closing enforcement device 20 is disposed on a hanger 109' comprising the lock assembly 10 and having a high-speed door hung therefrom. That is while a cam 21' is provided on the header 3, the roller 22' is mounted on the hanger 109' by the lever 23° and the bracket 24', and the other end of the lever 23' is biased by the spring 25.

With the door unit, the roller 22' is pressed into contact with the inclined cam surface of the cam 21' during the transition from right before the door fully-closed state to the door fully-closed state, to increase the door-closing force by a horizontal component exerted on the roller 22', as in the case with the aforementioned device.

Figure 45:
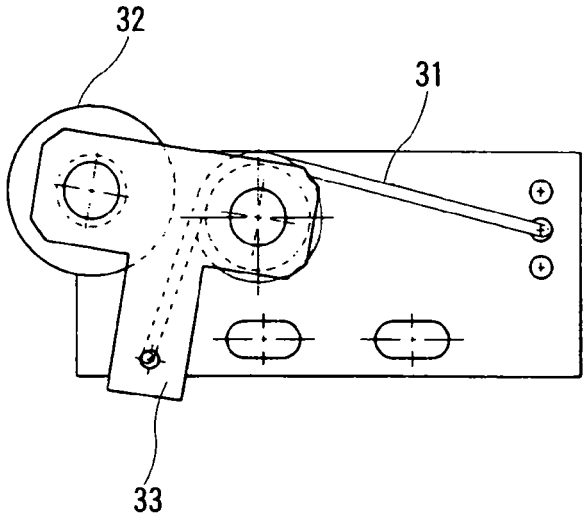
FIG. 45 is a front view showing another example of a door-closing enforcement device.
Figure 46:
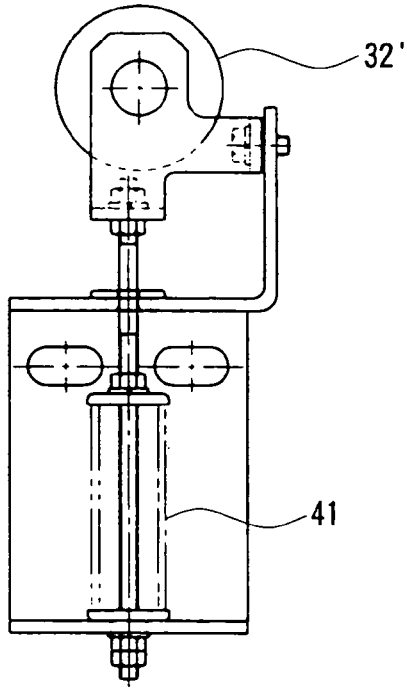
FIG. 46 is a front view showing further another example of a door-closing enforcement device.

Furthermore, FIGS. 45 and 46 show another example of a roller supporting device with the device for increasing door-closing force. With the example shown in FIG. 45, used as a member for biasing the roller 32 is a torsion spring 31. A T-shaped lever 33 having the roller 32 provided on its one end is rotatably biased clockwise by the torsion spring 31. The roller 32 is pressed into contact with the cam 21 (21') to achieve space saving.

On the other hand, with an example shown in FIG. 46, the lever is omitted, and the roller 32' is biased vertically upward by a coil spring 41. This allows the use of the spring 41 having a small spring constant.

As described above, with the door unit of the present embodiment, a simple structure is added to the conventional unit whereby the door can be reliably closed to a fully closed position despite the provision of the smoke shielding mechanism and the environmental conditions around the door unit.

The invention claimed is:

1. An elevator comprising an entrance frame provided on an entrance leading from a landing hall to a hoistway, having an upper frame and a vertical frame, and landing doors arranged with a gap between the entrance frame and the landing doors, guided by a sill for opening-closing an opening of the entrance frame, a door unit of the elevator being characterized in that the door unit of the elevator includes smoke shielding members, for preventing the infiltration of smoke, on at least one of a top portion of the landing doors and a member opposed to the top portion of the landing doors, on at least one of a side portion of the landing doors and a member opposed to the side portion of the landing doors, and on at least one of a bottom portion of the landing doors and a member opposed to the bottom portion of the landing doors, the landing door is coupled to a door-closing enforcement device for pressing the landing door in a door-closing direction from a position of the landing door when the smoke shielding members touch the landing door or the member opposed to the top, side, or bottom portions of the landing doors to a door fully-closed position, wherein the smoke shielding member provided on the side portion of the landing door is fitted into a recess of a bracket, and the bracket is adjustably arranged, wherein the smoke shielding member on the bottom portion or the upper portion of each door comprises a pair of projections gradually spreading toward an outer end, wherein the pair of projections are fitted into a recess of an opposed member, and the projections are deformed with temperature or pressure differences of the environment.

2. A door unit according to claim 1 wherein one of the smoke shielding member and the opposed member is adjustably provided.

3. A door unit according to claim 2 wherein a stop board is provided on the opposed member to be opposed to the smoke shielding member provided on the upper portion of the landing doors, and the stop board is adjustably arranged.

4. A door unit according to claim 1 wherein the smoke shielding member on the side portion is in contact with the smoke shielding member on the bottom portion at a lower position.

5. A door unit according to claim 4 wherein the smoke shielding member on the side portion and the smoke shielding member on the bottom portion are arranged on the same vertical plane.

6. A door unit according to claim 5 wherein two smoke shielding members are connected to each other on respective ends thereof.

7. A door unit according to claim 1 wherein the smoke shielding member on the side portion is arranged so as to be in contact with the smoke shielding member on the top portion at an upper position.

8. A door unit according to claim 7 wherein the smoke shielding member on the side portion and the smoke shielding member on the top portion are arranged on the same vertical plane.

9. A door unit according to claim 8 wherein the smoke shielding member on the side portion and the smoke shielding member on the top portion are connected to each other on respective ends thereof.

10. A door unit according to claim 1 wherein all of the smoke shielding members are deformed with temperature or pressure difference of the environment.

11. A door unit according to claim 1 wherein the smoke shielding member is mounted thereon with a member to be moved with pressure difference.

12. A door unit according to claim 1 wherein the smoke shielding member on the bottom portion is provided beside a portion to which a guide shoe is attached.

13. A door unit according to claim 1 wherein the smoke shielding members arranged on the side portion and the bottom portion of the landing doors are different members.

14. A door unit according to claim 13 wherein the smoke shielding member provided on the side portion of the landing doors is a hollow member or an L-shaped member.

15. A door unit according to claim 1 wherein the landing doors are central open doors, and the smoke shielding members provided on the landing doors are in contact with each other without a gap there between.

16. A door unit according to claim 1 wherein the doors include a plurality of doors for opening the opening from the center into opposite directions.

17. A door unit according to claim 1 wherein the smoke shielding member has a body made from elastic material and having a surface subject to coating by surface-activity-modifying treatment.

* * * * *

UNITED STATES PATENT AND TRADEMARK OFFICE

CERTIFICATE OF CORRECTION

PATENT NO. : 7,510,055 B2
APPLICATION NO. : 10/513329
DATED : March 31, 2009
INVENTOR(S) : Morotome et al.

It is certified that error appears in the above-identified patent and that said Letters Patent is hereby corrected as shown below:

On the Title Page, item (54) title, and Col. 1, line 5 DOOR DEVICE OF ELEVATOR should be changed to:

(54) DOOR UNIT OF ELEVATOR

Signed and Sealed this

Second Day of June, 2009

John Doll

JOHN DOLL
*Acting Director of the United States Patent and Trademark Office*